US007571623B2

(12) United States Patent
Kretchmer et al.

(10) Patent No.: US 7,571,623 B2
(45) Date of Patent: Aug. 11, 2009

(54) MAGNETICALLY ATTRACTABLE COMPONENTS FOR SELF-SIZING JEWELRY ARTICLES

(75) Inventors: Steven Kretchmer, Palenville, NY (US); Joseph Stupak, Portland, OR (US)

(73) Assignee: Claudia Kretchmer, Scottsdale, AZ (US)

( * ) Notice: Subject to any disclaimer, the term of this patent is extended or adjusted under 35 U.S.C. 154(b) by 119 days.

(21) Appl. No.: 10/552,535

(22) PCT Filed: Apr. 9, 2004

(86) PCT No.: PCT/US2004/010986

§ 371 (c)(1), (2), (4) Date: Jul. 7, 2006

(87) PCT Pub. No.: WO2004/091334

PCT Pub. Date: Oct. 28, 2004

(65) Prior Publication Data

US 2007/0051131 A1 Mar. 8, 2007

Related U.S. Application Data

(63) Continuation-in-part of application No. 10/411,619, filed on Apr. 10, 2003, now Pat. No. 7,013,674.

(60) Provisional application No. 60/473,040, filed on May 23, 2003, provisional application No. 60/473,041, filed on May 23, 2003.

(51) Int. Cl.
*A44C 9/02* (2006.01)

(52) U.S. Cl. ..... 63/3; 63/3.1; 63/15.45; 63/15.65

(58) Field of Classification Search ..... None
See application file for complete search history.

(56) References Cited

U.S. PATENT DOCUMENTS 486,256 A 11/1892 Leevy et al. ..... 70/15

(Continued)

FOREIGN PATENT DOCUMENTS

EP 271423 A1 6/1988

(Continued)

*Primary Examiner*—Jack W. Lavinder
(74) *Attorney, Agent, or Firm*—Winston & Strawn LLP

(57) ABSTRACT

A magnetic jewelry-forming component for preparing a jewelry article. The article includes a body member configured and dimensioned in an ornamental shape and having a first magnetizable portion for attractive or repulsive magnetic association with at least one other magnetic jewelry-forming component and at least one further element for magnetically coupling to the at least one other magnetic jewelry-forming component. Advantageously, the body member has a magnetic strength that can be overcome by a person's hand strength such that the body member and at least one other magnetic jewelry forming component can be placed in different positions relative to each other. Also, the further element includes (a) a second magnetized portion that has a polarity that is different from that of the at least one other magnetic jewelry-forming component so that it is magnetically attracted thereto or (b) a retaining structure that prevents complete separation of the body member from the at least one other magnetic jewelry-forming component when the first magnetized portion of the body member has a polarity that is the same as that of the at least one other magnetic jewelry-forming component so that it is magnetically repulsed therefrom. These components enable the jewelry article to be self-sizing by repulsion or attraction, to include the use of multiple fields to reduce damaging magnetic emanations from the article, or to control position or motion of the components in the article to provide highly desirable and unusual jewelry articles.

8 Claims, 17 Drawing Sheets

U.S. PATENT DOCUMENTS

| | | | | |
|---|---|---|---|---|
| 2,745,265 | A * | 5/1956 | Grafstein | 63/15.6 |
| 3,263,444 | A | 8/1966 | Di Croce | 63/15.7 |
| 3,423,956 | A | 1/1969 | Manne | 63/15.45 |
| 3,589,341 | A | 6/1971 | Krebs | 119/865 |
| 3,755,796 | A | 8/1973 | Griest, Jr. | 340/174 |
| 4,221,615 | A | 9/1980 | Shine | 148/120 |
| 4,853,048 | A | 8/1989 | Shimizu et al. | 148/300 |
| 4,901,405 | A | 2/1990 | Grover et al. | 24/303 |
| 4,905,335 | A | 3/1990 | Tervola | 7/169 |
| 4,912,944 | A | 4/1990 | Crosley et al. | 63/29.2 |
| 4,941,236 | A | 7/1990 | Sherman et al. | 24/303 |
| 4,983,230 | A | 1/1991 | Overfelt et al. | 148/300 |
| 5,008,984 | A | 4/1991 | Levy | 24/303 |
| 5,050,276 | A | 9/1991 | Pemberton | 24/303 |
| 5,092,019 | A | 3/1992 | Levy | 24/303 |
| 5,097,682 | A | 3/1992 | Nakamura | 63/14.1 |
| 5,099,659 | A | 3/1992 | Carranza et al. | 63/2 |
| 5,197,168 | A | 3/1993 | Levy | 24/303 |
| 5,307,582 | A | 5/1994 | Quintel | 40/633 |
| 5,311,647 | A | 5/1994 | Levy | 24/303 |
| 5,317,789 | A | 6/1994 | Levy | 24/303 |
| 5,323,516 | A | 6/1994 | Hartmann | 24/303 |
| 5,349,725 | A | 9/1994 | Levy | 24/303 |
| 5,353,608 | A | 10/1994 | Berkowitz | 63/1.1 |
| 5,367,891 | A | 11/1994 | Furuyama | 63/29.2 |
| 5,392,497 | A | 2/1995 | Definer | 24/303 |
| 5,412,956 | A | 5/1995 | Levy | 63/15.65 |
| 5,432,986 | A | 7/1995 | Sexton | 24/303 |
| 5,586,374 | A | 12/1996 | Nishida | 24/599.8 |
| 5,664,298 | A | 9/1997 | Nessar-Ivanovic | 24/303 |
| 5,675,874 | A | 10/1997 | Chen | 24/303 |
| 5,722,260 | A | 3/1998 | Mangano | 63/3.1 |
| 5,806,346 | A | 9/1998 | Schlinger et al. | 63/40 |
| 5,913,707 | A | 6/1999 | Roman et al. | 446/131 |
| 5,920,966 | A | 7/1999 | Chen | 24/303 |
| 5,989,178 | A | 11/1999 | Chin | 600/15 |
| 6,116,053 | A | 9/2000 | Siebenberg | 63/15 |
| 6,116,982 | A | 9/2000 | Roman et al. | 446/131 |
| 6,282,760 | B1 | 9/2001 | Mars | 24/303 |
| 2002/0069670 | A1 | 6/2002 | Rosenberg | 63/15.7 |
| 2003/0177787 | A1 | 9/2003 | Kou | 63/15.45 |

FOREIGN PATENT DOCUMENTS

| | | |
|---|---|---|
| GB | 2055552 A | 3/1981 |

* cited by examiner

MAGNETICALLY ATTRACTABLE COMPONENTS FOR SELF-SIZING JEWELRY ARTICLES

CROSS-REFERENCE TO RELATED APPLICATIONS

This application is a continuation of International Application PCT/US2004/010986 filed Apr. 9, 2004, which is a continuation-in-part of copending U.S. non-provisional application Ser. No. 10/411,619 filed Apr. 10, 2003 now U.S. Pat. 7,013,674, and claims the benefit of U.S. provisional applications 60/473,040 and 60/473,041 each filed May 23, 2003.

BACKGROUND ART

The invention relates to jewelry components that are magnetized and joined to form new and unusual jewelry articles having heretofore unknown properties and advantages.

In particular, the present invention relates to jewelry components that are magnetically attractable to or repulsed by each other so a plurality of such components can be joined or combined into rings, bracelets, chains, chokers, necklaces, earrings, watchbands or the like, with the magnetic force holding the components together or apart, as desired. Also, components can be connected in any one of a number of positional relationships so that the final jewelry article is self-sizing to the wearer.

Jewelry articles are generally made of different types of precious metals and stones and are held together by mechanical linkages or interconnections. This is of course well known to the skilled artisans and in common use today. Designers are somewhat limited by these mechanical connections, and it would be desirable to have other joining forms for creation of new and unusual jewelry articles.

The use of magnetic force to join components is known in the field. Various permanent magnets have been used, and these can be provided with very strong magnetic fields. They are generally used to hold two oppositely magnetized components together. Such permanent magnets are generally made of non-precious metal alloys and for that reason are not desirable for use in fine jewelry.

While there have been some attempts at making precious metal magnets, two problems have been encountered. Many precious metal magnets do not possess sufficient magnetic strength to secure jewelry components together. Furthermore, attempts at alloying such metals to increase their magnetic strength causes excessive dilution of the precious metal content of the alloy, thus rendering it less desirable for use in jewelry components or articles. A magnetized platinum cobalt alloy is known, but previously has not been deemed to be suitable for use in jewelry components or articles.

In addition, highly magnetic jewelry articles can be problematic in certain situations. Contact of strong magnets with credit cards, computer disks or other magnetically sensitive materials can cause damage to such materials. Also, rings, bracelets and necklaces, if strongly magnetized, are generally located such that they can easily come in contact with magnetically sensitive materials to cause damage or loss of information therein.

Also, when a person wishes to purchase an article of jewelry to be worn, care must be taken to assure that the size of the piece is correct. When purchasing an item such as a bracelet or necklace, the size is selectable from one of a plurality of standard lengths at the desire of the purchaser. Other items, such as watchbands, are provided with removable links so that the size can be selected to conform to the size of the person's wrist. For other items, such as a ring, the jeweler will usually measure the size of the person's finger so that the ring can easily slide along the person's finger into place. It is often difficult to properly size the ring so that it can be snugly maintained in place as it must also be sufficiently large to pass over the person's knuckles, especially for people that have arthritic joints. This means that the ring must be sized larger to accomplish this and then will be too loose when in the proper position. Also, the person's finger can change in size over the years, and a ring that is correctly sized at one time can end up being incorrectly sized in the future.

The accommodation of different sizes creates difficulties for the jewelry manufacturer and seller, in that different sizes must be made available, or specialized orders must be custom made to the person's actual or desired dimensions. It would be desirable to avoid having to carry large inventories of different sized jewelry articles, as well as to avoid having to make custom sized pieces for each customer. These problems are now solved by the present invention.

It also would be desirable to have magnetically joinable jewelry components to assist designers in creating new visual appealing designs or for these components to have magnetic strengths that are sufficiently strong to securely join jewelry components together. The present invention now satisfies these needs.

Also, it would be desirable to have magnetically joinable jewelry components to assist designers in creating new visual appealing designs. It is also desirable for these components to have magnetic strengths that are sufficiently strong to securely join jewelry components together without emitting or radiating high magnetic fields that can cause damage to magnetically sensitive materials or similar items. The present invention now satisfies these needs and provides other advantages for use in fine and costume jewelry applications.

SUMMARY OF THE INVENTION

The present invention relates to a magnetic jewelry-forming component for preparing a jewelry article. The article comprises a body member configured and dimensioned in an ornamental shape and having a first magnetizable portion for attractive or repulsive magnetic association with at least one other magnetic jewelry-forming component and at least one further element for magnetically coupling to the at least one other magnetic jewelry-forming component. Advantageously, the body member has a magnetic strength that can be overcome by a person's hand strength such that the body member and at least one other magnetic jewelry-forming component can be placed different positions relative to each other. Also, the further element comprises (a) a second magnetized portion that has a polarity that is different from that of the at least one other magnetic jewelry-forming component so that it is magnetically attracted thereto or (b) a retaining structure that prevents complete separation of the body member from the at least one other magnetic jewelry-forming component when the first magnetized portion of the body member has a polarity that is the same as that of the at least one other magnetic jewelry-forming component so that it is magnetically repulsed therefrom. The jewelry-forming component generally has an ornamental shape that includes a curved or arcuate surface, an annular configuration or a ring.

In one embodiment, the body member has at least one female element associated therewith for magnetically attracting and receiving a male element of the at least one other, magnetic jewelry-forming component, with the first magnetized portion providing a minimum magnetic strength that is sufficient to retain the male element within the female element and a maximum magnetic strength that can be overcome by a person's hand strength to separate the male and female elements, such that a plurality of such components can be magnetically coupled to form an article of jewelry. The body member can have an arcuate shape with the female element is located at an end of the arcuate shape, and wherein the female element defines a cavity having a depth sufficient to receive a male element of the other jewelry-forming component at different positional relationships therein.

Alternatively, the further element can be a male element that extends away from the female element and is located on the opposite end of the arcuate shape, with the male element having a forward end that is magnetically attracted to the first magnetizable portion of the body member of the at least one other magnetic jewelry-forming component. The body member then can be at least partially tubular and with first magnetized portion of the body member being provided by a magnetized pellet or disk member. Also, the further element can be female, element located on an opposite end of the tubular body member. Preferably, each female element defines a cavity having a depth sufficient to receive a male element at different positional relationships therein, and each female element is magnetized to attract oppositely polarized male elements.

Another embodiment of the invention relates to a jewelry article in the form of a ring, bracelet, anklet, chain, choker, necklace, or watchband comprising between two and two hundred jewelry-forming components defined herein. These articles are conveniently formed by a plurality of female element jewelry-forming components and a plurality of arcuate components having first and second male ends which are configured and dimensioned to be received and magnetically retained in the female elements of adjacent jewelry-forming components.

In yet another embodiment, the body member has outer and inner surfaces. The at least one other jewelry-forming component comprises at least one dimensioning member that is operatively associated with the body member with the first magnetizable portion of the body member and the dimensioning member having the same magnetic polarity. These components repulse each other with a maximum magnetic strength that can be overcome by a person's hand strength, such that the magnetic repulsion between the body and dimensioning members enables the component to attain a first configuration wherein the dimensioning member is positioned remotely from the body member and a second configuration wherein the person's hand strength urges the dimensioning members towards the body member. Thus, the jewelry component can be adjusted to conform to the person. The inner surface of the body member preferably defines a cavity having a depth sufficient to receive a plurality of dimensioning members that fit inside the cavity when urged therein by a person's hand strength. Alternatively, the dimensioning member is associated with the body member cavity with a mechanical connection that prevents complete separation of the at least one dimensioning member from the body member in the first configuration. The cavity may instead include a narrowed or partially blocked opening and the mechanical connection comprises an extension provided on the dimensioning member that fits through the narrowed opening and includes am end portion having a size or shape that is larger than the opening so that the at least one dimensioning member cannot be separated from the body member.

The body member of a preferred jewelry-forming component is configured in the shape of a ring and the at least one dimensioning member can have a configuration that can be received by the body member. The dimension members can be straight sections, buttons or can have a shape that is complementary to a portion of the body member of the ring. When the ring is oval or round, it can include any reasonable number of dimensioning members, with two to thirty-two being typical. Also, the ring can include a ramp positioned adjacent a dimensioning member to minimize gaps between adjacent dimensioning members. An advantage of these type constructions is that the jewelry article is self-sizing to the wearer.

In another embodiment, the further element comprises a plurality of additional magnetized locations so that the jewelry-forming component can be magnetically joined to another jewelry-forming component in one or multiple relative positions, and wherein the magnetic field emitted or radiated by the plurality of magnetized locations is effective at a distance that is less than that which would be present if the entire component is magnetized, so that the jewelry component does not have a deleterious effect on magnetic-sensitive items that are handled by a person wearing the jewelry component. The plurality of magnetized locations may be symmetrically distributed on the body member and each have about the same size and shape.

For any of these embodiments, an adornment of a precious stone, a material having a different color from that of the body member, indicia, or a part of a character, pattern or design can be included for further visual effects in the final article. For example, the magnetic field emitted or radiated by the plurality of magnetized locations can be configured in an indicia or other ornamental pattern that is invisible until revealed by magnetic particles or films. The plurality of magnetized locations can be arranged so that the components are uniquely engageable to form the article. Each of the at least two components can include between 4 and 40 magnetized locations and are magnetically aligned in more than two relative positions. The jewelry article can also magnetically join these components and their adornments to form a bracelet, brooch, pin or earring. The jewelry article can also include components that form a clasp, with the movement of the components from one position to another position signifying the proper closing of the clasp.

The jewelry article can be provided in the form of a continuous loop by magnetic coupling of first and second oppositely magnetized jewelry-forming components. For this embodiment, the first and second magnetized members are preferably at least partially arcuate in shape. They also can have an inner face so that they can be magnetically coupled in face to face relation. The first and second magnetized members advantageously have a C or U shape and are magnetically coupled so that open areas are not adjacent so that other articles can be releasably secured to the loop. This way, the loop can be openable as desired and can be a circular, elliptical or oval shape, and optionally with straight or linear portions.

The article may also be provided in the form of a ring comprising two jewelry-forming components and two arcuate male members that are magnetically interconnected. The article can also be connected wherein the male element of one component is magnetically coupled to the female element of another component. These articles include between two and two hundred jewelry-forming components connected end to end. For a ring, at least two to thirty components can be connected end to end to form the ring.

For rings, both of the members can include one or more adornments on the outer or inner surface or both surfaces. If desired, each outer surface can include a flat portion so that the members can also be magnetically coupled by contact of the flat portions. This allows the designer to allow at least one of the members to have adornments on the inner surface that are hidden when the members are magnetically coupled by contact of the inner surfaces, but which adornments are visible when the members are magnetically coupled by contact of the outer surfaces. Other forms include a ring, bracelet, necklace or chain link.

A preferred form for the jewelry article is an interlocked chain which comprises a plurality of continuous loops, wherein the loops are interlocked to form the chain. Also, one or more charms or adornments can be securely but releasably attached to one or more of the loops. The chain can optionally include a clasp for opening or closing the chain for placement on the wearer.

The jewelry article can also include a functional part for opening and closing the continuous configuration to facilitate connection or removal of the article for wearing. A preferred functional part is a hinge or clasp. The article can include components that form a clasp, with the movement of the components from one position to another position signifying the secure closing of the clasp. The jewelry article can also include a plurality of magnetized locations arranged to be offset for providing rotational movement to the components as they come together to automatically provide a mechanical interlock of the components.

When at least two components are used, they can include adornments so that, when the components can be magnetically joinable in at least two fixed positions, and the adornments cooperate with each other to form a first visual arrangement in one position and at least one other different visual arrangement in another position. In the article, the at least two components can be configured and dimensioned to be discontinuous but when magnetically joined are continuous so that other articles can be releasably added to the components prior to joining. Alternatively, at least one component can be fixed on the article while the other component can be magnetically joined or removed to the at least one component to provide different enhancements or adornments to the article.

In another preferred embodiment, the at least two jewelry forming components are provided with magnetized portions that facilitate retention of the components in spaced related in a first position, so that at least one component can be moved with respect to the other by a user and, when the user releases the moved component, it automatically returns to the first position. The jewelry forming components can be arranged on an axis so that one can be moved rotationally with respect to the other. This enables one component to be attracted to the other after being moved or to repulse the other after being moved. The designed has numerous options for creativity in the final article.

BRIEF DESCRIPTION OF THE DRAWING FIGURES

Additional features and advantages of the invention are provided and will become readily apparent from the following detailed description and accompanying drawing figures, wherein.

Figure 3:
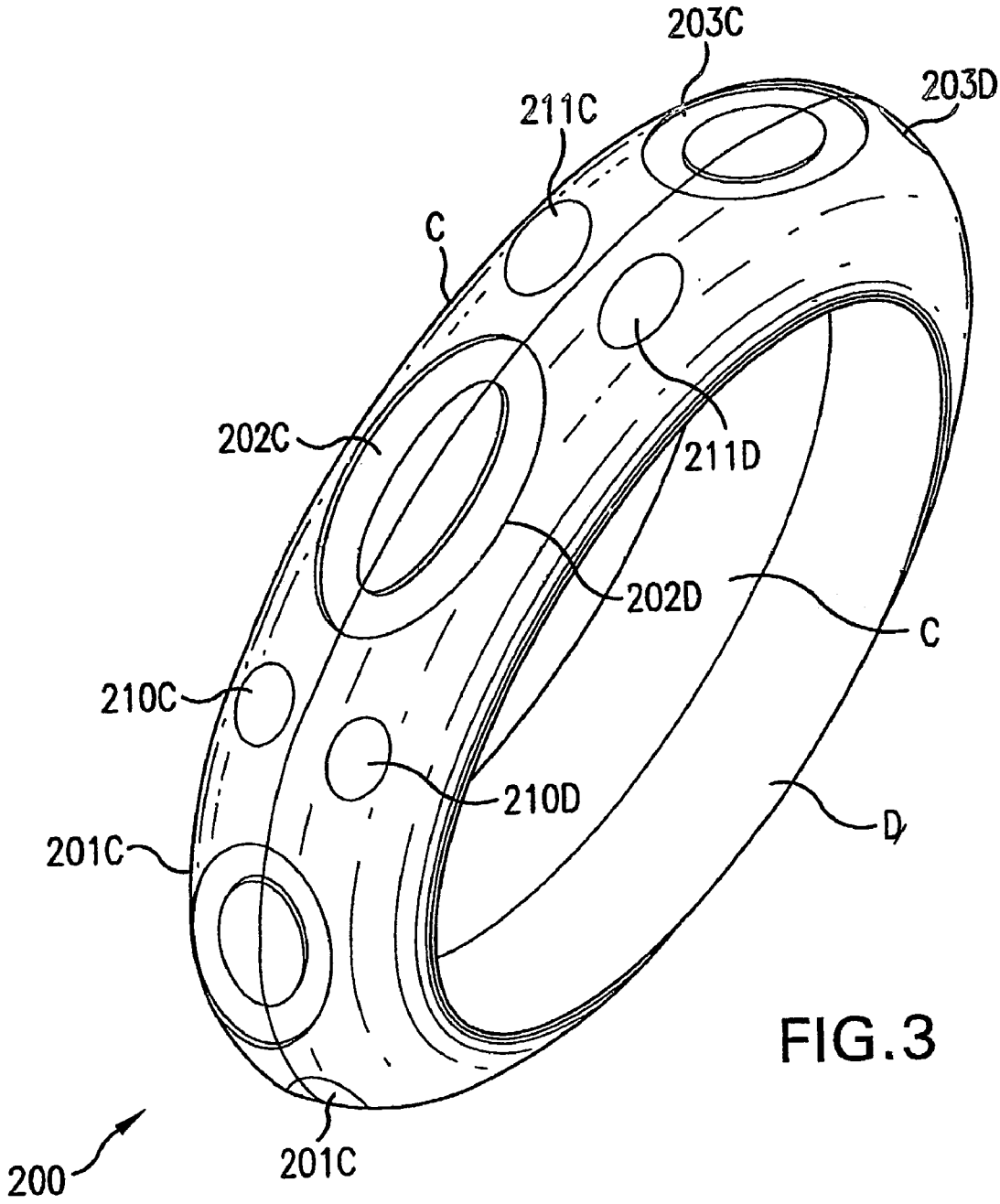
Figure 4:
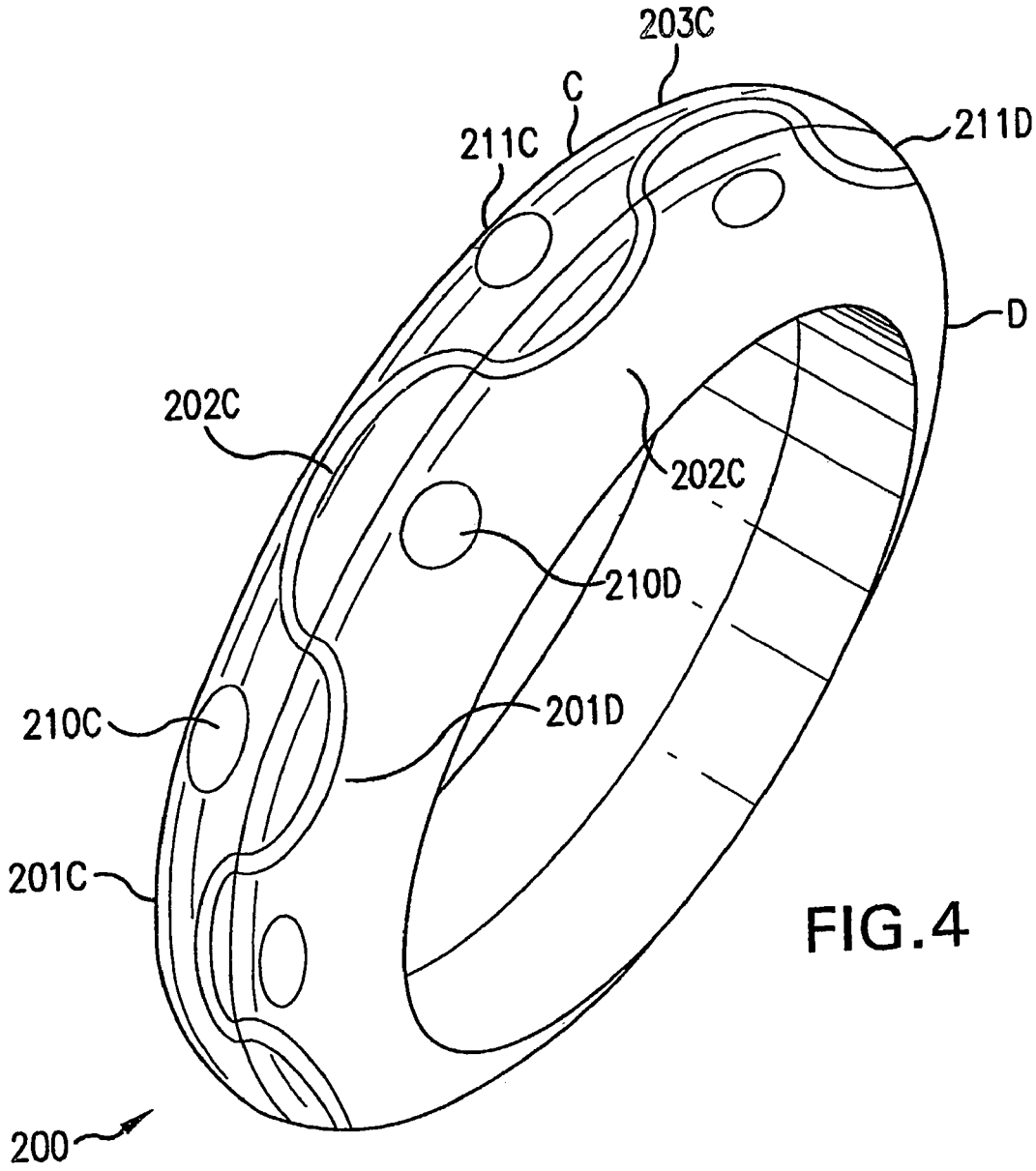
Figure 6A:
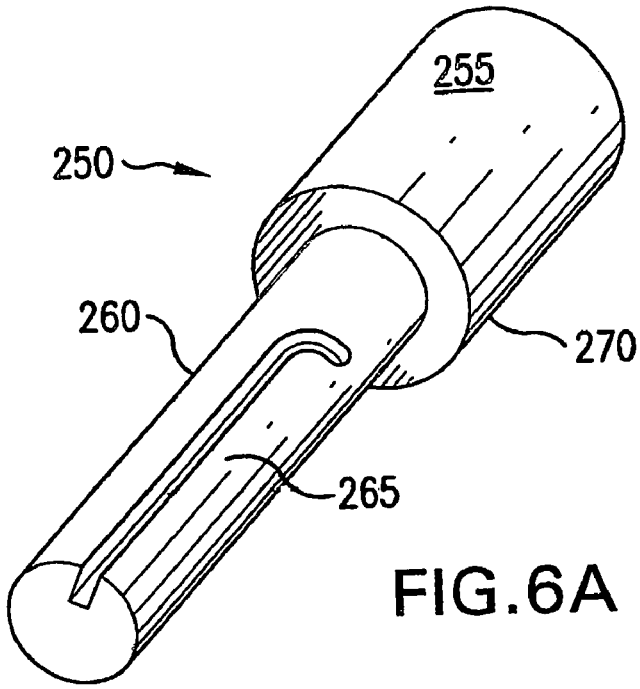
Figure 6B:
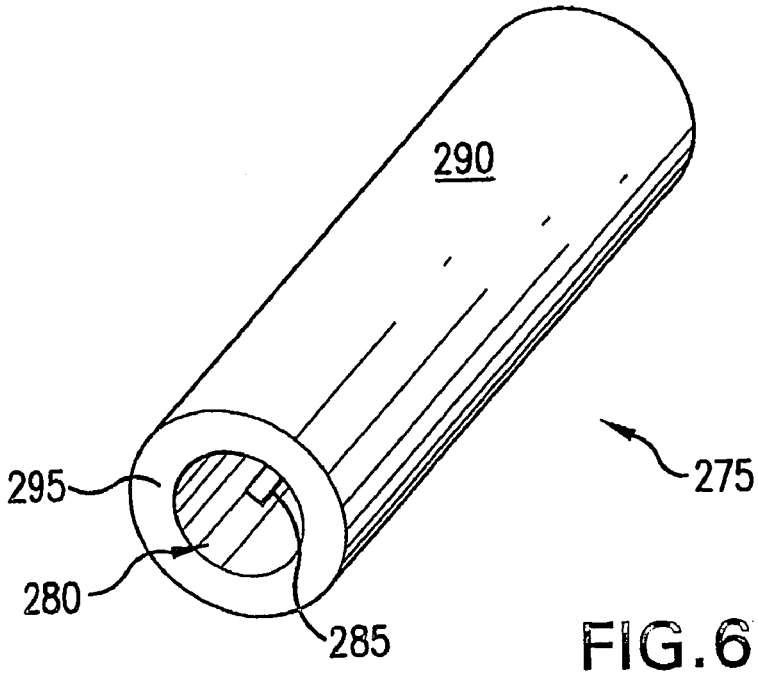
Figure 7:
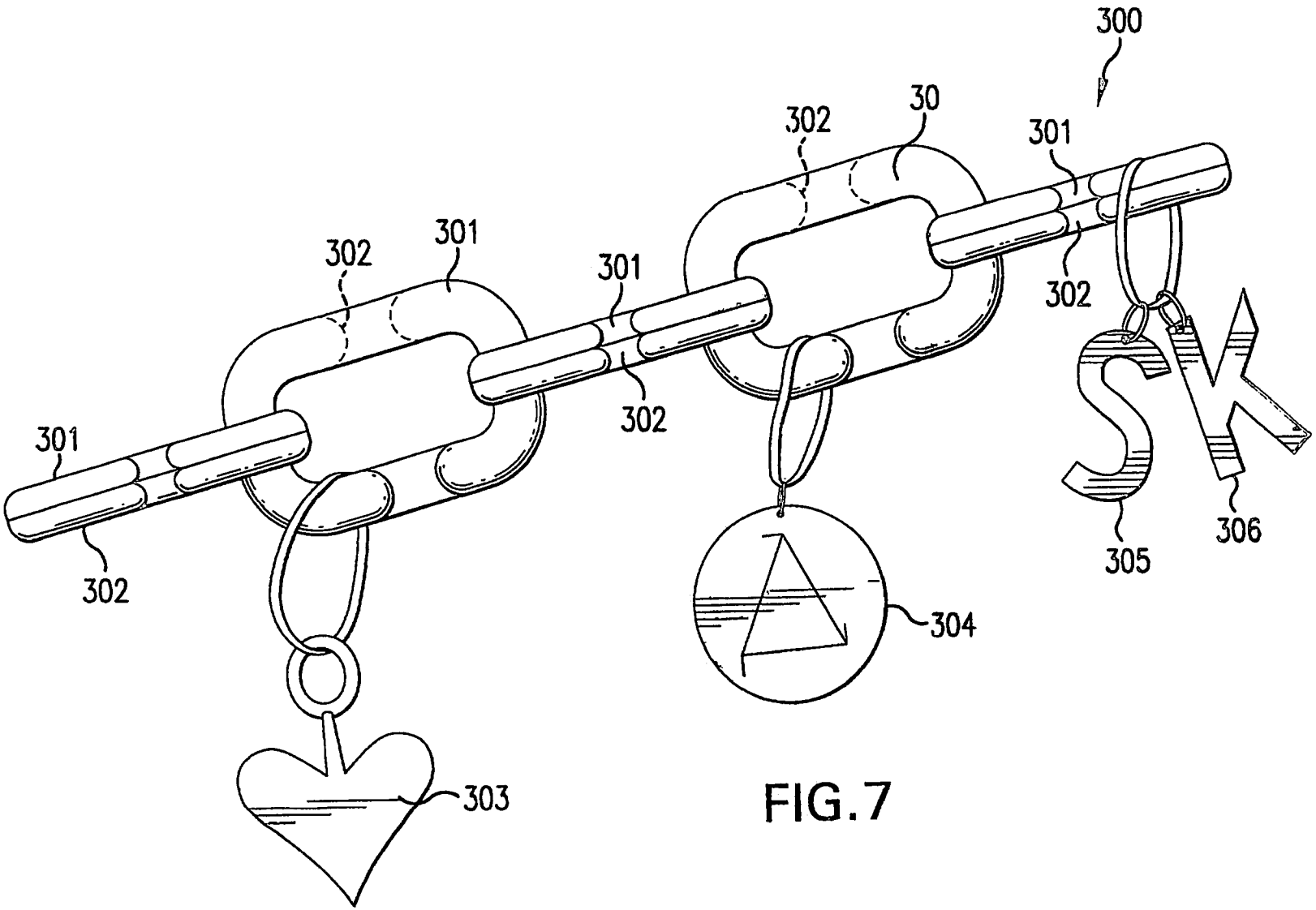
Figure 8:
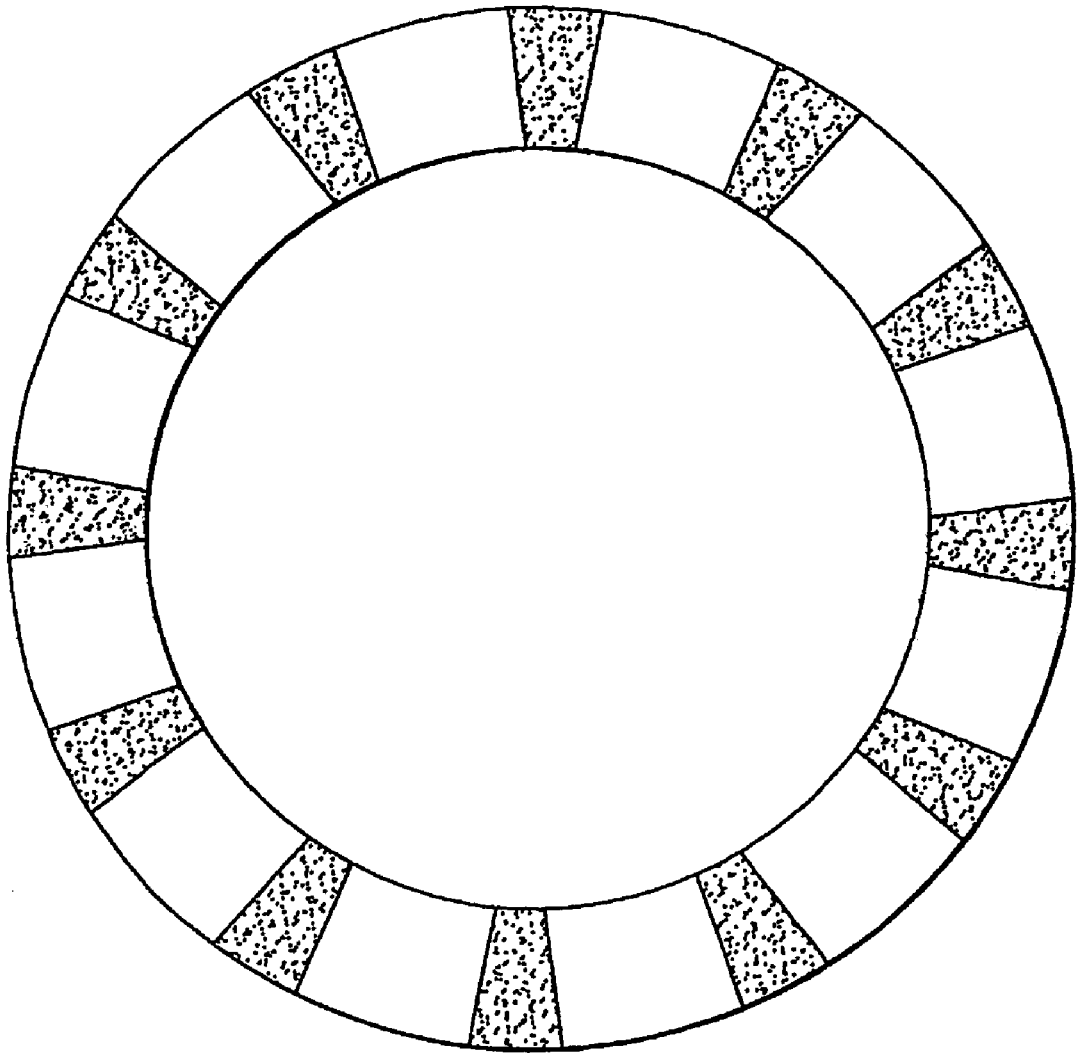
Figure 9:
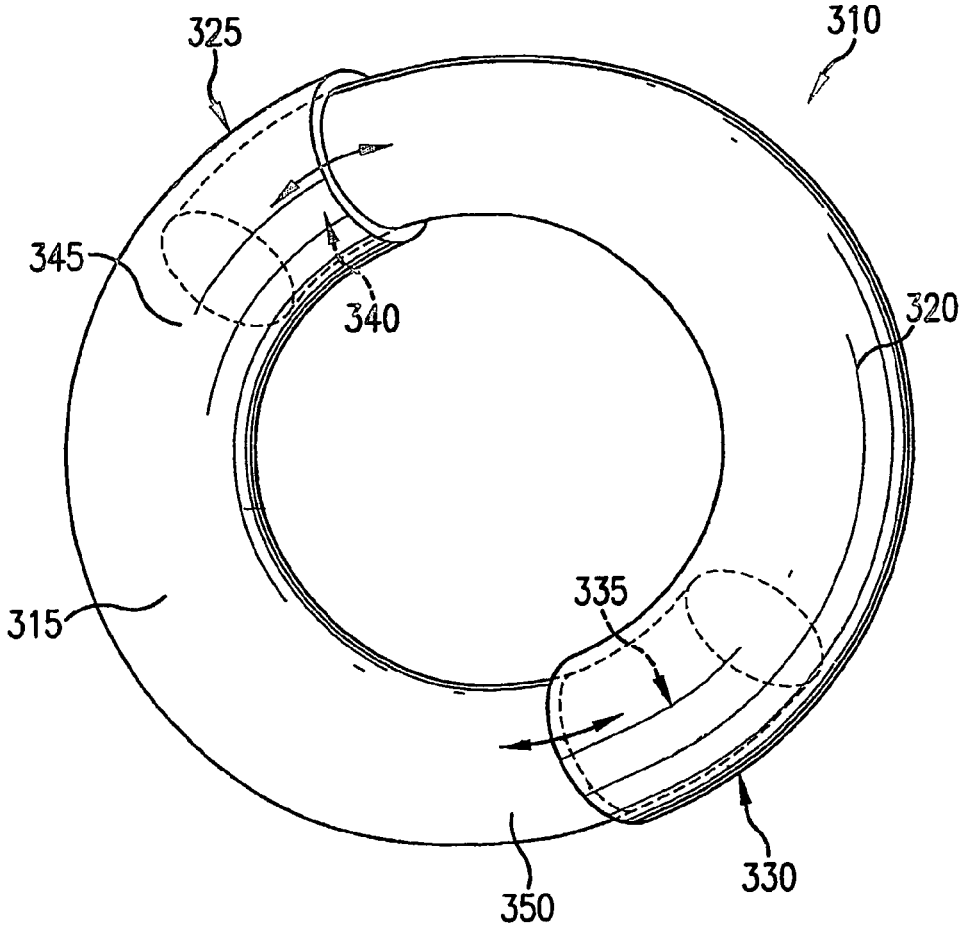
Figure 10:
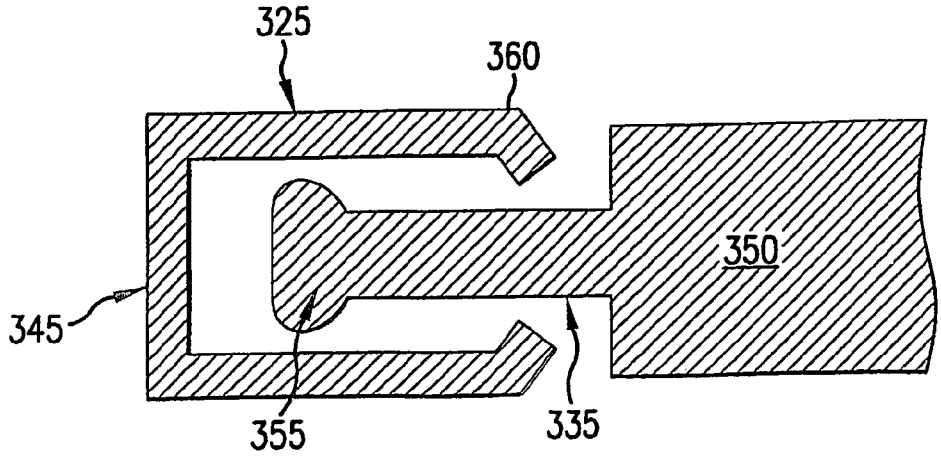
Figure 11:
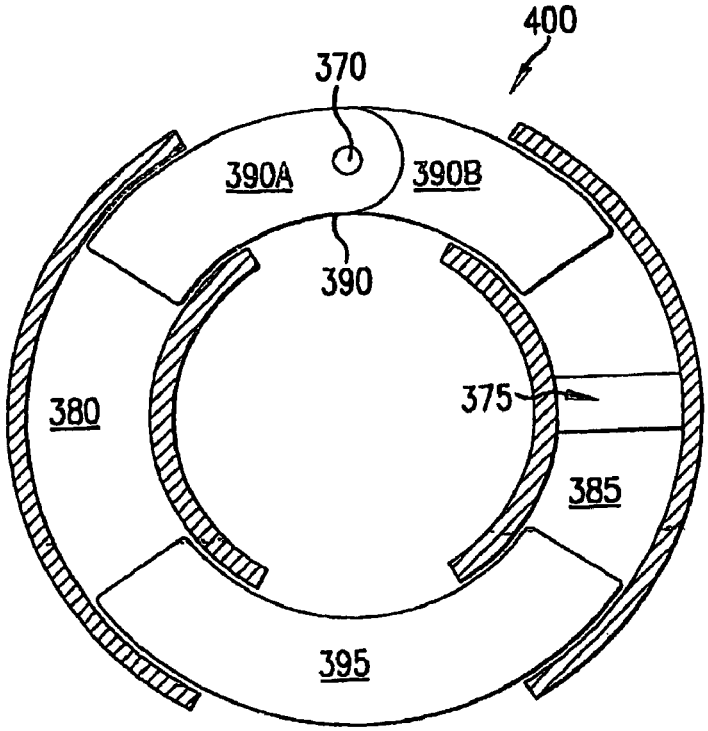
Figure 12:
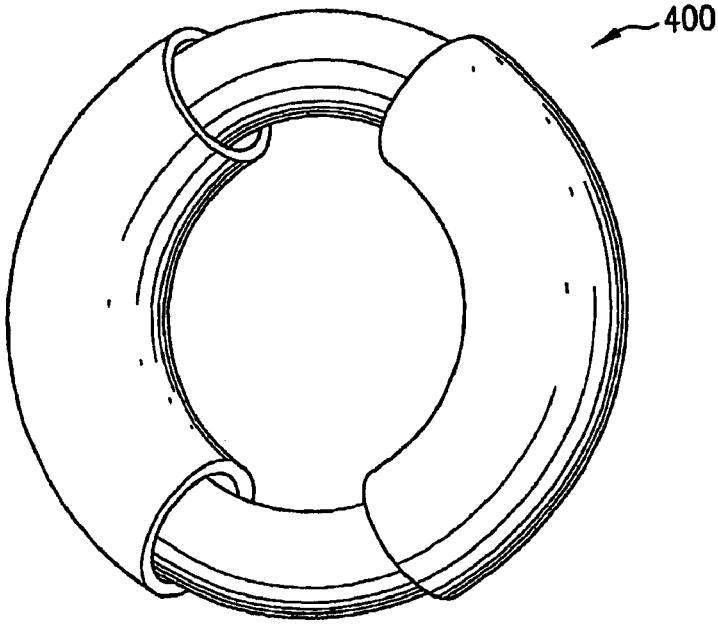
Figure 13:
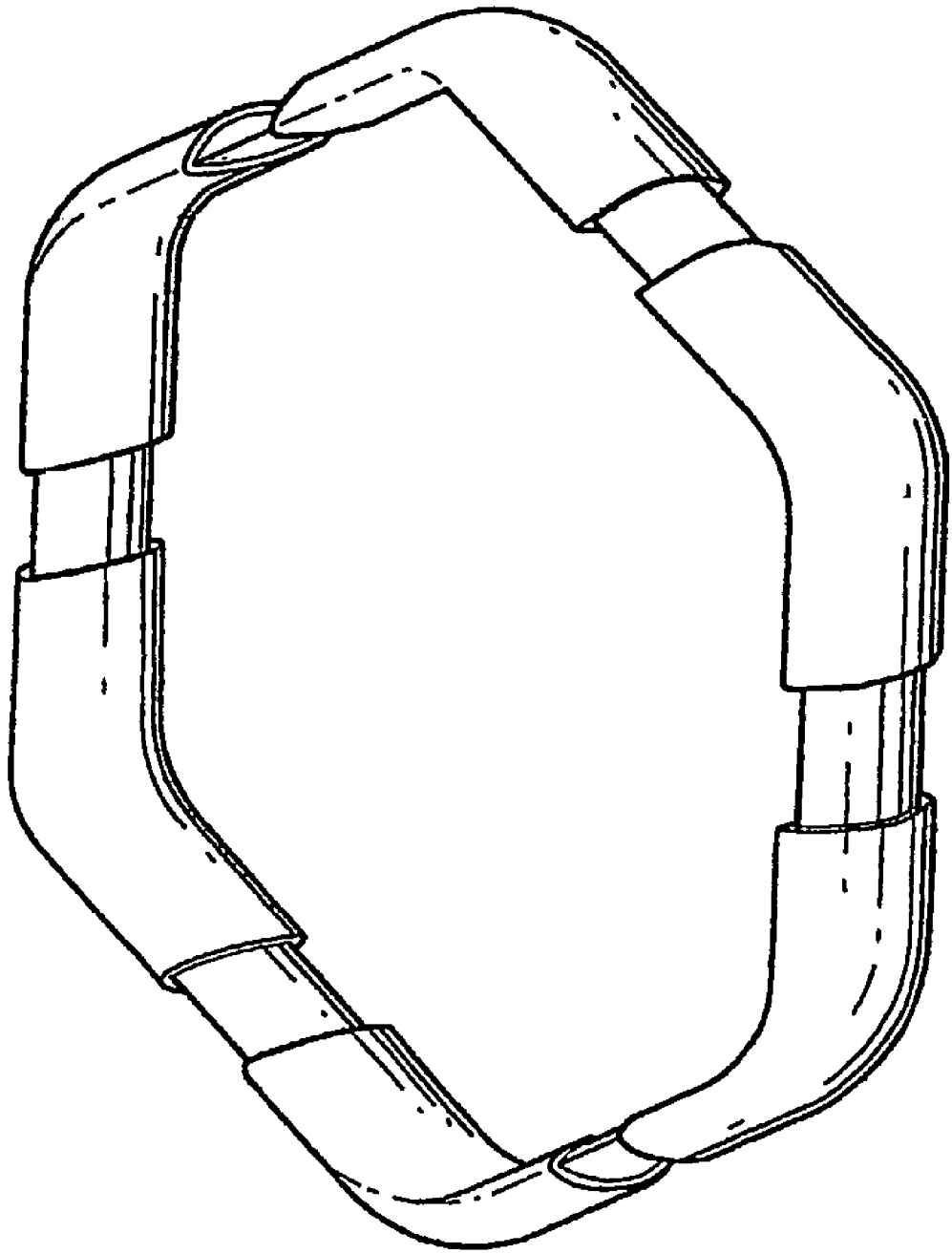
Figure 14A:
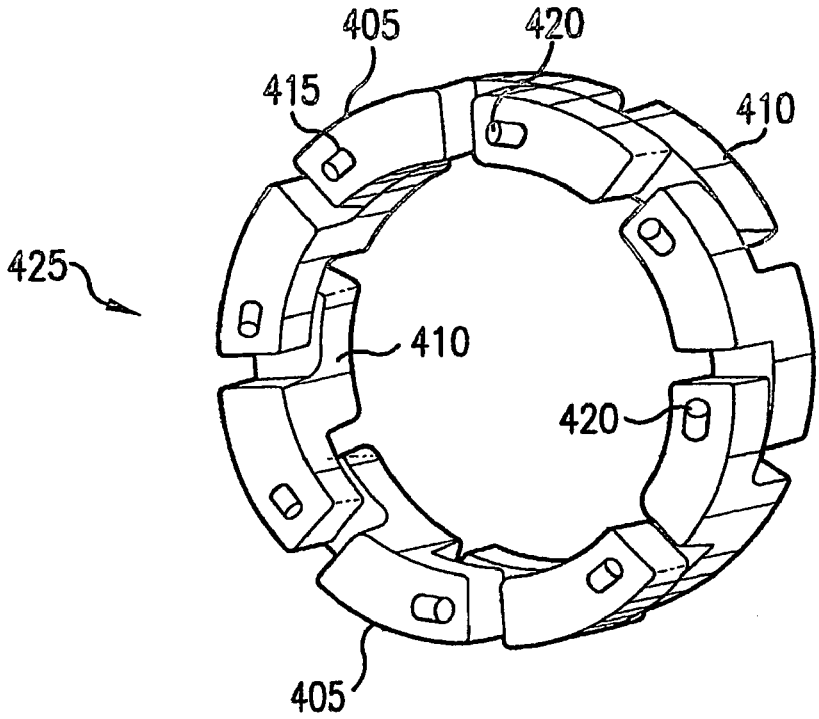
Figure 14B:
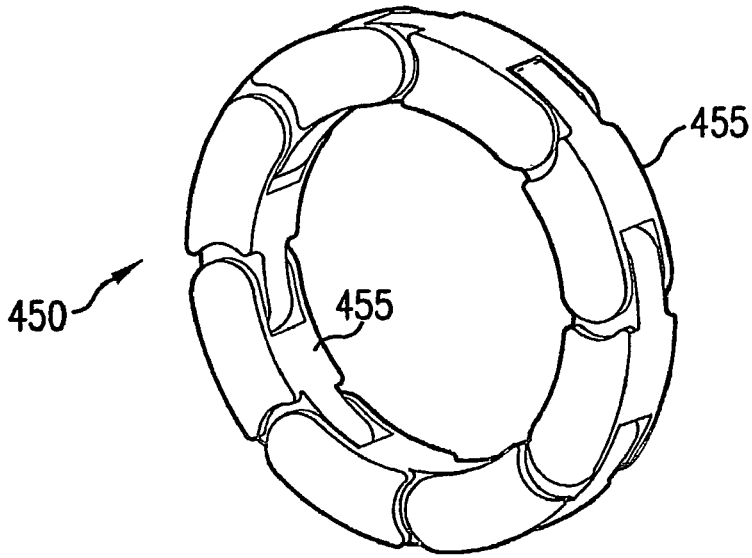
Figure 15A:
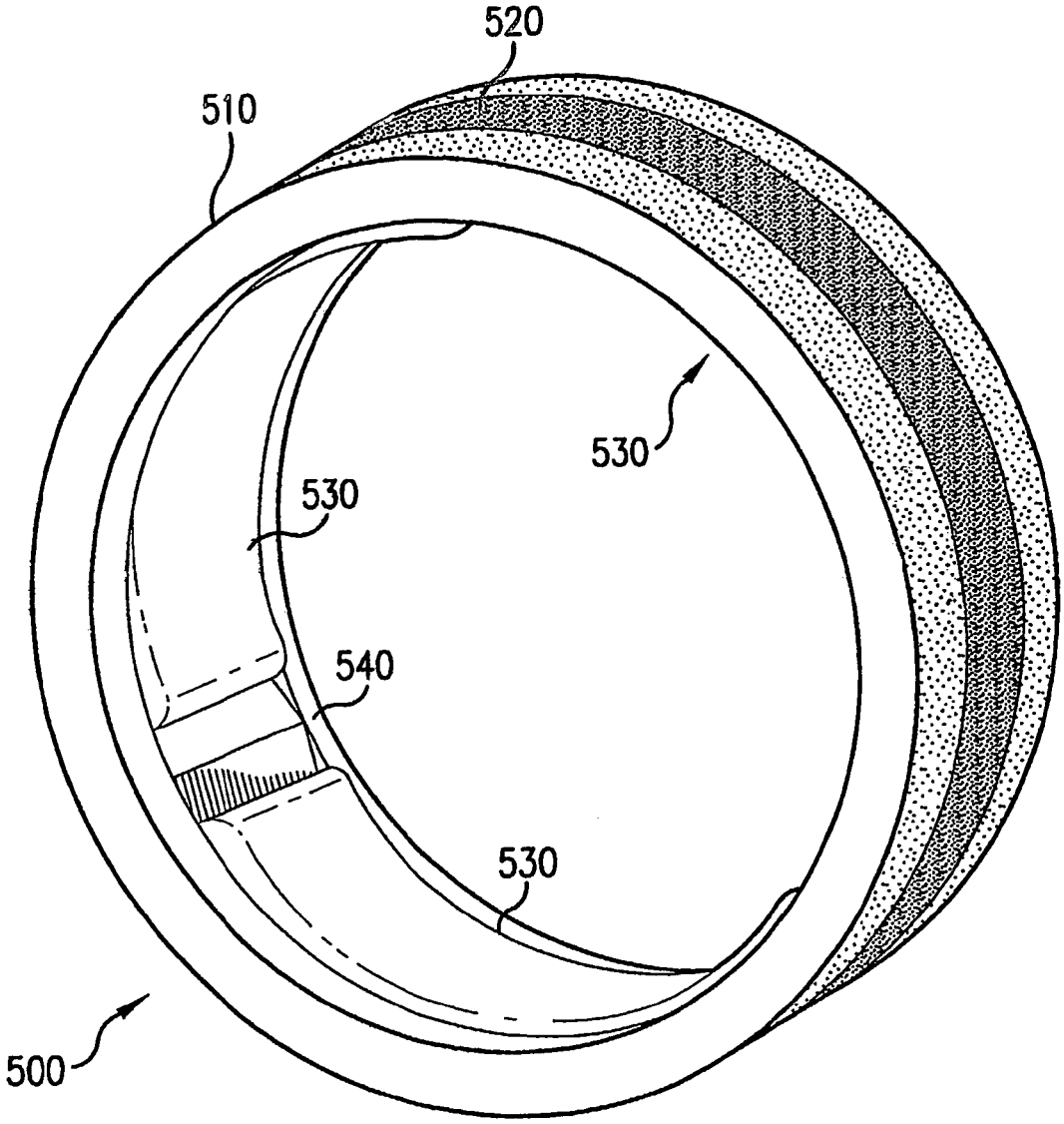
Figure 15B:
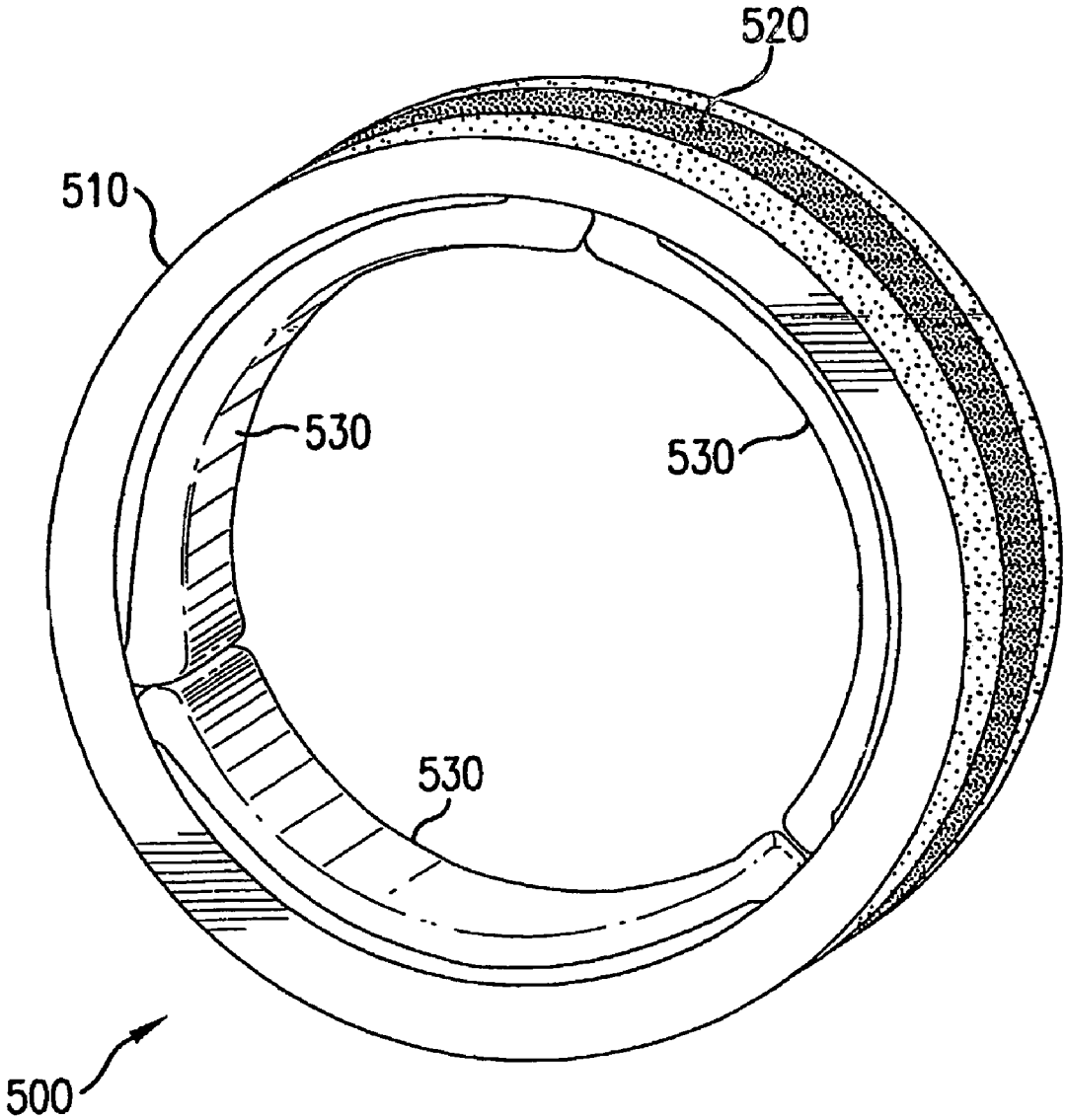
Figure 16A:
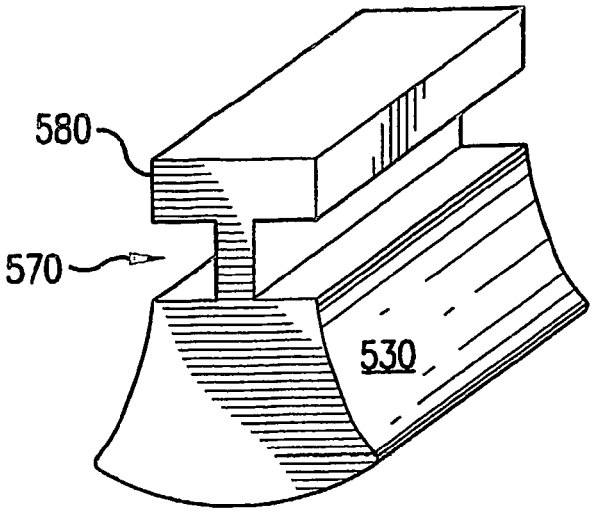
Figure 16B:
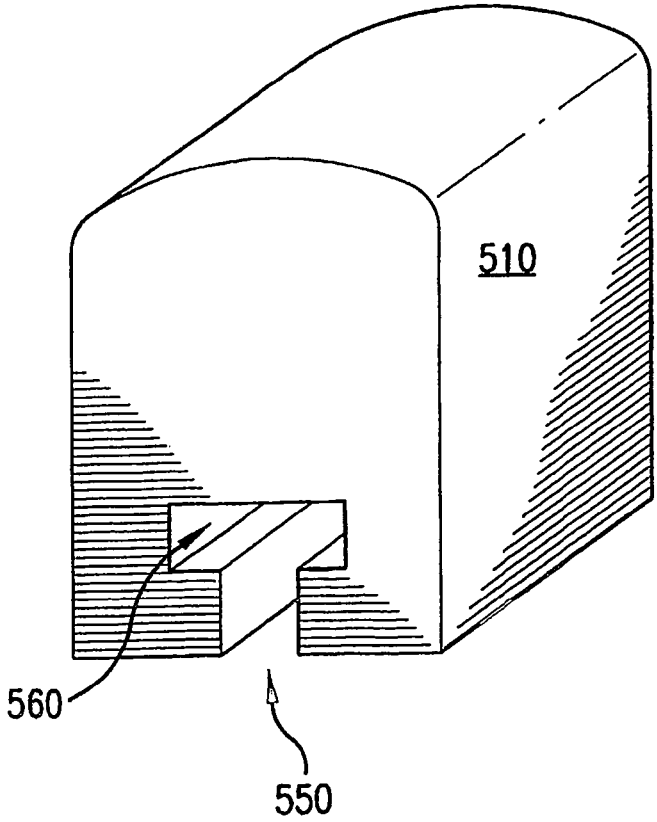
Figure 17:
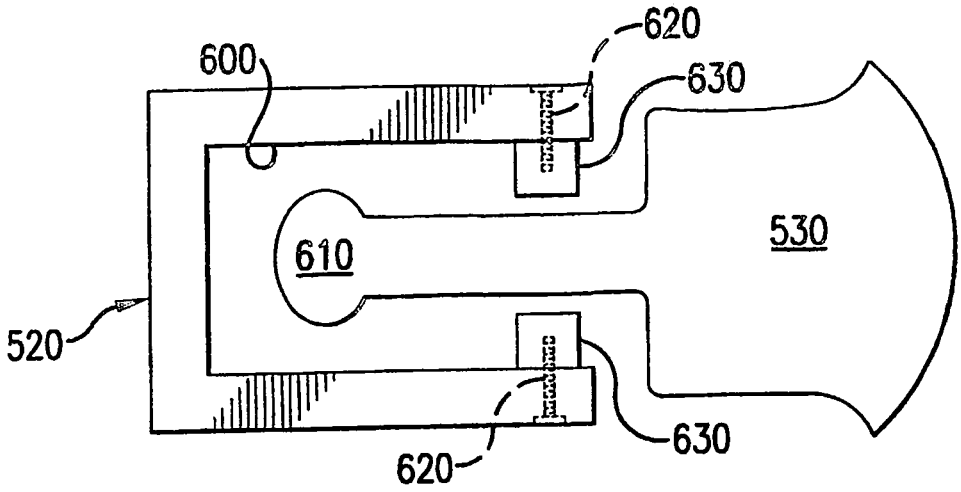

FIGS. 3 and 4 perspective views of another ring according to invention to illustrate different magnetically joined positions;

FIGS. 5A and 5B are front views of two ring inner surfaces that are separated to illustrate the magnetized areas of each;

FIGS. 6A and 6B each illustrate a component of a two-component clasp;

FIG. 7 is a view of a chain made of C-shaped jewelry components according to the invention;

FIG. 8 is an illustration of multiple poles created in a single ring component by using a multiple pole magnetizing fixture;

FIG. 9 is an illustration of a ring made of two magnetically mating jewelry-forming components according to the invention;

FIG. 10 is an illustration of an example a connection that is resistant to separation for the components of FIG. 9;

FIG. 11 is an illustration of a different configuration of a ring made of four magnetically mating jewelry-forming components according to the invention, with certain features illustrated in phantom;

FIG. 12 is a view of the overall appearance of the ring of FIG. 11;

FIG. 13 is a view of a hexagonal shaped ring;

FIGS. 14A and 14B are illustrations of a self-sizing ring based on magnetic attraction of the component parts;

FIGS. 15A and 15B are illustrations of a self-sizing ring based on magnetic repulsion of the component parts;

FIGS. 16A and 16B are illustrations of a first arrangement for connecting the dimensioning members and body member for the self-sizing ring of FIGS. 15A and 15B;

FIG. 17 illustrates a second arrangement for connecting the dimensioning members and body member for the self-sizing ring of FIGS. 15A and 15B.

Figure 18A:
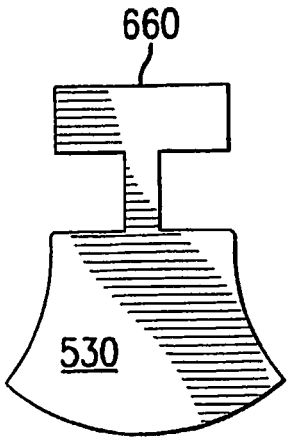
Figure 18B:
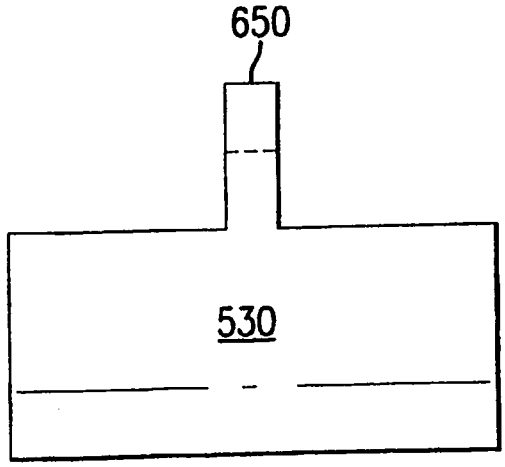
Figure 19A:
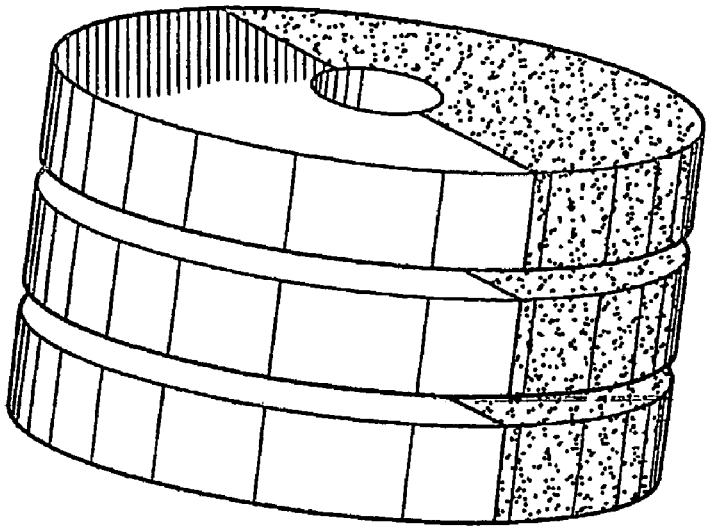
Figure 19B:
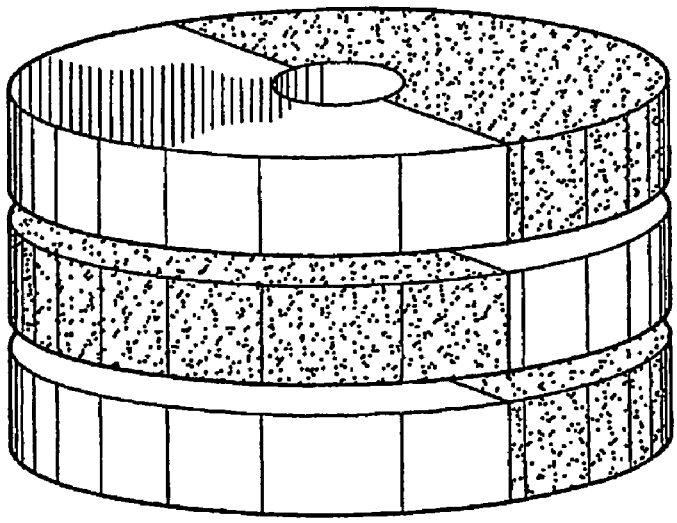

FIGS. 18A and 18B are illustrations of a third arrangement for connecting the dimensioning members to the body member of the self-sizing ring of FIGS. 15A and 15B; and FIGS. 19A and 19B illustrate a jewelry component of a magnetic hinge member.

DETAILED DESCRIPTION OF THE PREFERRED EMBODIMENTS

The term "loop" is utilized herein to refer to a final article that has no beginning and no end, i.e., a ring, oval, polygon or like configuration. This loop can partially or fully arcuate or can have straight or linear portions therein. It also can be configured as a tube of any cross sectional configuration.

Figure 1:
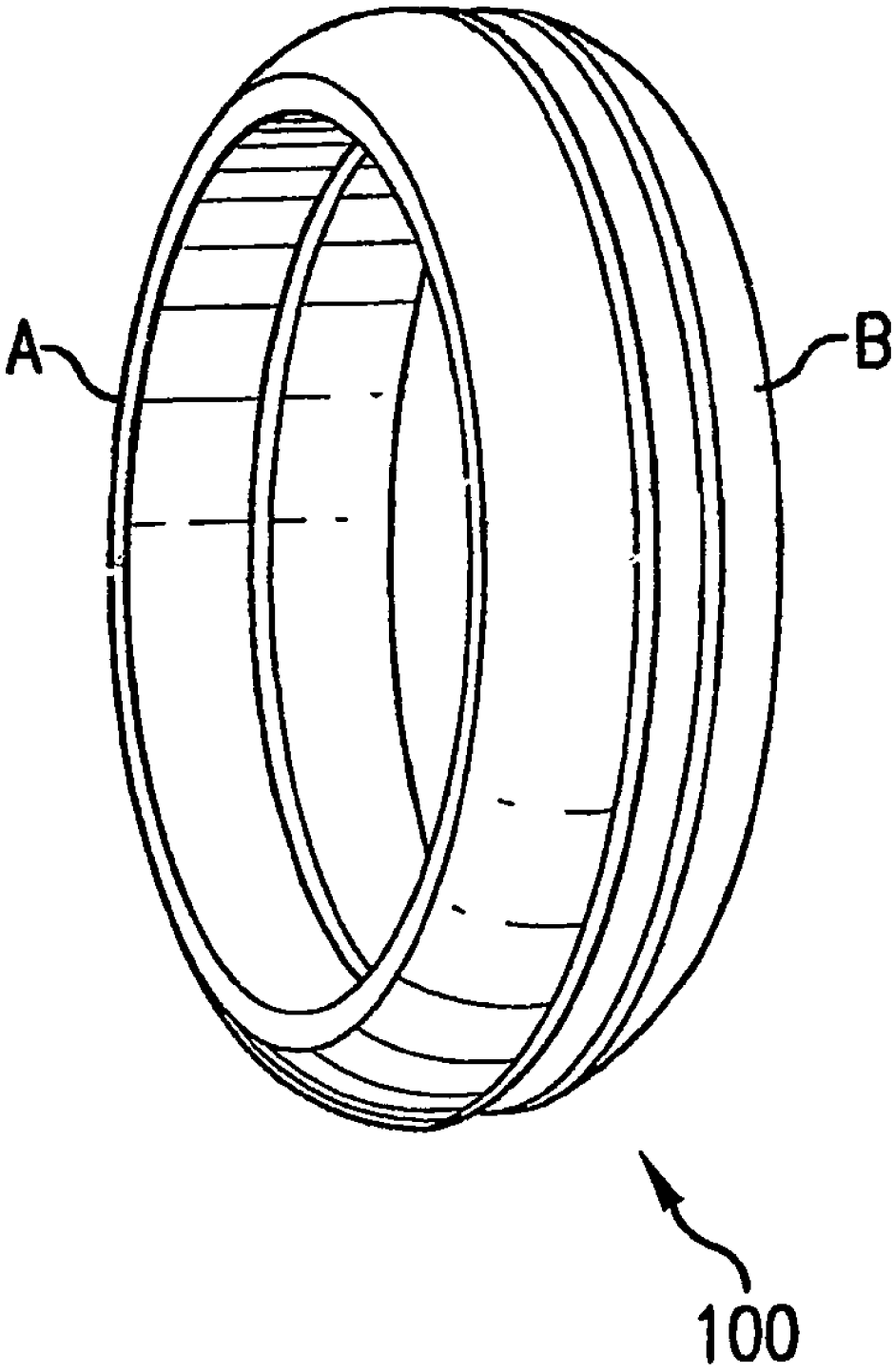
FIG. 1 is a perspective view of a split ring according to the invention and that is magnetically joined and ready to wear.

FIG. 1 illustrates a typical split finger ring 100 having two symmetrical ring portions A, B and being in a joined condition. In this embodiment, the split ring is provided in two portions, each magnetized with opposing polarities so that the portions are magnetically attracted to each other. In use, the portions are held together by magnetic force. Even so, the magnetic strength of the joined components can be overcome by had force. The components can be separated much more easily by applying a shearing force rather than by trying to pull apart the components in directly opposite directions. For this reason, it is sometimes useful to design a flange or other retention member that prevents sliding motion for shearing the parts.

One particularly useful advantage is the ability of the ring to take on different external appearances. This feature is illustrated schematically in FIGS. 3 and 4, which illustrate ring 200 having ring portions C and D. The rings are joined together by magnetic force in one alignment in FIG. 3 and a different related alignment in FIG. 4. Inlaid designs 201C, 201D, 202C, 202D, 203C, 202D, etc. are provided along the outer surfaces of the ring portions C, D, with part of the design appearing on each portion. In the arrangement shown, the design is an ellipse, half of which is provided by each ring portion. Of course other arrangements are possible where a greater or lesser portion of the design is provided by each ring portion.

As shown in FIG. 3, the ellipse is aligned, while in FIG. 4, the halves of the ellipse provide the appearance of a meandering line or a sine wave. Of course other positions can provide different appearances, such as two "U" shaped portions facing each other in an offset position wherein one end of each "U" shaped portion is positioned midway, or otherwise, between the ends of the other.

In addition, the ring portions C, D can include precious stones or other non-metal adornments, illustrated schematically as 210C, 210D, 211C, 211D, etc. In one position, shown in FIG. 3, these are aligned while in FIG. 4, they are shown as offset. The inner side of the ring that is not normally seen when being worn is shown without any ornamentation, but the same type features described above can be used to create secret messages or designs therein. The jeweler is thus able to create a wide variety of different features in a single ring.

Figure 2:
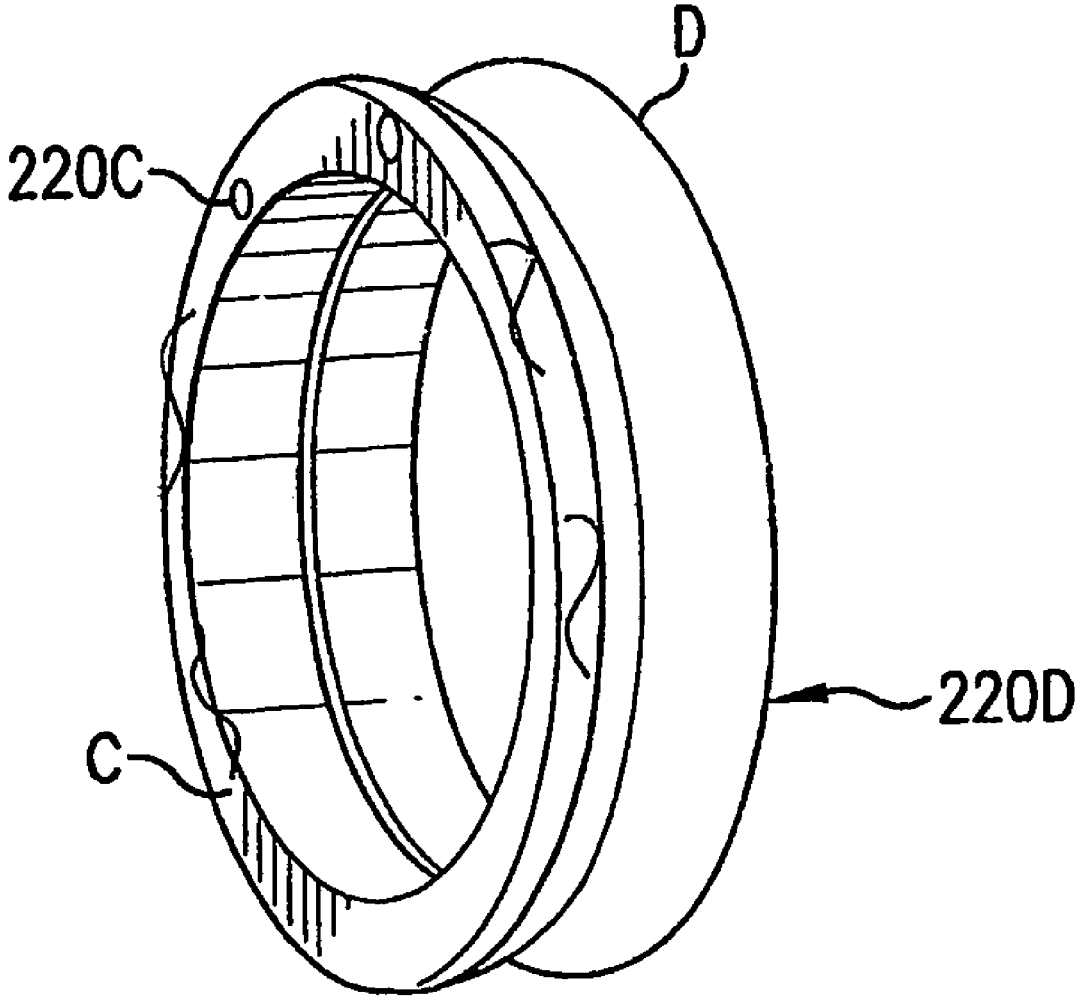
FIG. 2 is a view of the ring of FIG. 1 in a reverse position.

In addition to the previous designs, the surfaces of the ring that contact each other for joining can be provided with stones, inlaid designs, writings or other ornamental features, as disclosed in Kohl U.S. Pat. No. 5,669,241. As the present, in one embodiment, the ring has no clasp, and the ring portions can be reversed or worn separately to expose the previously hidden adornments. These hidden adornments would be similar to what is provided in a traditional Gimmal or Twin-ring. The reversed ring portions are shown in FIG. 2, with the adornments being present on ring faces 220C and 220D. The particular ring thus provides a dramatically different appearance than when the ring portions are reversed. Also, although not shown in FIG. 2, the same side inlaid portions and/or stones would be visible in yet another pattern than when the ring portions are reversed.

Of course, any designs, indicia, ornamentation or adornments can be provided. These can be isolated, interconnected, or otherwise provided on the ring sides to achieve the desired appearances. In addition, it is possible for the wearer to purchase different colors or appearances to thus create many different ring designs to coordinate with the appropriate clothes worn or social gathering. In this way, multicolor designs of hearts, flowers, words or the like can be provided as designed by the user.

The term "adornment" is used herein to generally define any item that is added to the jewelry component or article. This would include stones, stone mountings, or inserts, overlays, or other attachments of a precious, semi-precious or non-precious metal or alloy, or of coatings of metal, plastic or elastomers that are provided upon or with the component or article. The adornment is preferably permanently attached or joined to the component or article but it can also be releasably associated with the component or article, e.g., a charm.

In another embodiment, one person can wear half of the ring or a separate ring, i.e., one ring portion, while another wears the other half or a complementary ring on an opposite hand. When the people hold hands, the ring portions or complementary rings attract thus signifying the attraction of one person to the other. It is also possible to prepare a two piece article, such as a split or cracked heart or pendant, where each piece has an opposite polarity. Thus, each party can wear one of the pieces and these pieces would attract and magnetically connect when brought together. This allows each couple that shares the pieces to be attracted and mated to the other.

The embodiment of FIG. 1 also illustrates a split ring in two portions, each magnetized with a different polarity so that the portions are magnetically attracted to each other, with the force of the magnetism contained so that the ring does not provide magnetic forces that would interfere with magnetic responsive articles such as computer disks, credit cards, watches and the like. This can be done by imparting magnetic forces that produce short magnetic field lines so that the components are attracted to themselves but without emitting significant field lines.

To reduce magnetic force, each portion of the ring is not completely magnetized, but is instead magnetized only in certain discrete areas. For example, a plurality of alternating magnet pole segments on the surface can be created, as shown in FIG. 8. When this ring portion comes into contact with its mate, the opposite poles will attract and the portions will align themselves to the opposite pole. This alignment is automatic and imparts relative motion to the components, which motion can be used to advantage in providing mechanical interlocking, positioning or rotating. When the ring portions are circular in circumference and having mating faces that contact for magnetic connection, a plurality of spaced magnetized areas are spaced about the mating surfaces of the rings. The same number of magnetized areas can be provided on each ring portion, or different numbers of such areas can be provided so that the ring is only capable of being positioned in certain ways. In another preferred embodiment, as shown, the discrete magnetized areas are equally spaced about the ring face and the same number of areas are provided on each ring portion.

Another desirable component for use in jewelry articles is the magnetic hinge member as shown in FIGS. 19A and 19B. This hinge automatically rotates due to the fixation of the top and bottom magnets while the middle magnet is allowed to rotate. The light portions of each magnet signify one polarity, while the dark areas signify the opposite polarity. In the arrangement of FIG. 19A, at least one of the magnets is fixed so that the others are free to rotate in response to movement out of a magnetically stable position. For example, the top and bottom magnets can be fixed so that they can urge the middle magnet to rotate to take the position shown in FIG. 19B. Thus, a used can re-position the middle magnet as shown in FIG. 19A, but the magnetic force urges the middle magnet to rotate back to the position shown in FIG. 19B. Alternatively, the normal position of the magnets can be as shown in FIG. 19B, with the wearer rotating the middle magnet to the position shown in FIG. 19A. After the wearer's force is removed, the middle magnet will rotate back to the position shown in FIG. 19B. This rotational movement can be used to create a wide variety of interesting designs in jewelry, wherein the design can be moved to one position before it rotates to another position. This type structure can be used for clasps or other types of linking components.

The relative size of the magnetized areas is also taken into consideration. While the same size areas can be magnetized for convenience, different size areas can be provided as well. In general, the larger the size of the magnetized area, the lesser number of such areas are needed on the ring portion for secure joining. It is desirable to make the matching magnetized areas of each ring portion the same size, but this is not critical.

One reason for making multiple areas of magnetic field is to obtain relative small but short localized field strengths. These would provide much weaker overall emanation of magnetic strength than if the entire ring or jewelry object is to be magnetized. Also, the smaller magnetized areas can be more superficial in nature, so that the field lines do not radiate far beyond the object if at all. Thus, the jewelry has no deleterious affect on watches, credit cards, computer disks or related items, while still providing magnetic force sufficient to impart the desired features to the jewelry.

It should be noted that the magnetic strength of the joined components can be overcome much more easily by applying a shearing force rather than by trying to pull apart the components in directly opposite directions. For this reason, it is sometimes useful to design a flange or other retention member that prevents sliding motion for shearing the parts.

In a useful arrangement for a finger ring, between 6 and 48 equally spaced magnetic poles are provided around each ring portion. Preferably, 8 to 24 poles are used, with particularly advantageous effects being obtained with 12 to 16 poles. In general, between 4 and 100 poles can be used. The poles can be provided as shown in FIG. 8, where the darker areas illustrate the magnetized portions of the ring and the lighter areas indicate non-magnetized portions. In that Figure, 12 poles are provided, but the only limits to the number of poles are the size of the component and the patience of the jewelry manufacturer to create the magnetizing fixtures at impart the necessary polarities. For example, when 48 poles are used, the components can be configured in any one of at least 6 different relative positions. When 12 poles are used as shown in FIG. 8, three different relative positions can be provided.

Figure 5:
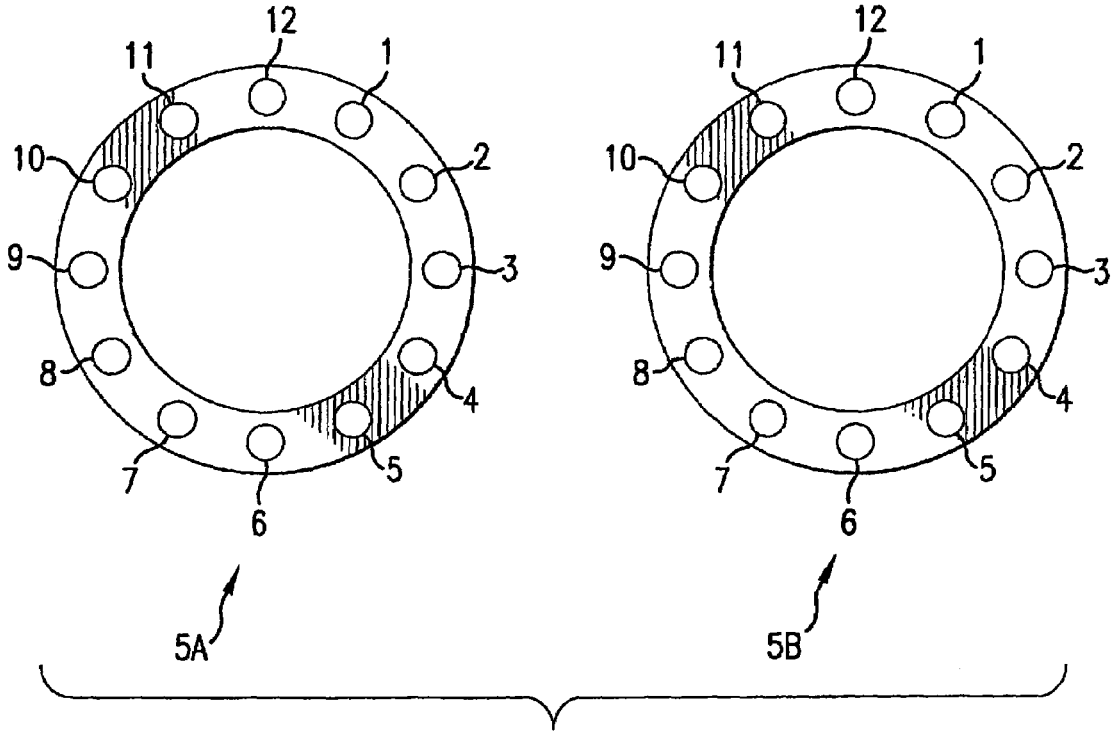

FIG. 5 illustrates two ring portions A, B each provided with 12 pole, 1, 2, . . . 12. It is possible to rotate one ring position with regard to the other so that they can be magnetically joined in any one of twelve relative positions; i.e., where pole 1 on ring portion A is opposite pole 1 on ring portion B, pole 1 on ring portion A is opposite pole 2 of ring portion B, etc. The wearer of the ring can rotate the ring portions while wearing the ring to move between these positions. Each time the ring portions are moved into a subsequent position, the person can feel the sensation of the ring portions being attracted into the new position with a tactile, snapping effect. In addition to providing amusement to the wearer, this discernable sensation provides other advantages as discussed herein.

In another embodiment, when the portions are combined as a two piece article, for example, the split or cracked heart or pendant mentioned above, the poles can be positioned on these piece such that only the true mating piece will form the magnetic connection. This allows each couple that shares the pieces to be uniquely attracted and mated only to each other and not to any other portions.

In yet another embodiment, the multiple poles can be configured in the component as an indicia or other ornamental pattern that would be invisible during wearing of the component until and unless particles or films of magnetizable indicators, e.g., iron filings or films that are responsive to magnetic fields, come into proximity with the component. These embodiments indicate the wide range of utility of the present invention.

The invention is not limited to rings but can be applied to many different types of jewelry components of the types disclosed herein. For example, the magnetic portions can be used to form chain links, clasps or stone mountings. One portion can be used to magnetically mount an adornment onto any other portion that forms part of a larger jewelry article. For example, a bracelet or necklace can be provided with magnetized portions that can receive other magnetized portions that carry stones, crystal or contrasting color components or the like. In this way, the owner of the piece can custom design it for the occasion by attaching the desired color coordinated stones or colored portions for example to complement an outfit or signify the occasion.

Another advantageous utility of the tactile sensation of the portions clicking or locking into position is when the portions are utilized as part of a clasp having no visible means of connection. The clicking provides an indication of a positive locking of the parts together so that the user knows that the article has been properly joined for wearing. In addition, the multiple poles can be offset so that upon contact of the components, the poles impart a rotational movement to one component relative to the other, and this movement can be used to create an automatic mechanical interlock as the component moves from one position to another. This provides an even more secure connection and closing of the clasp.

This feature is illustrated in FIGS. 6A and 6B, where a specially designed clasp is created from the mating of two components 250, 275. Component 250 has a generally cylindrical head portion 255 and a generally cylindrical male element 260 extending therefrom. The male element 260 has an L-shaped groove 265 on its exterior surface. Component 275 has a generally cylindrically shaped body 290 and is of approximately the same external dimension as that of the head portion 255. Component 275 has an internal bore 280 to receive male element 260 and a pin member 285 that rides in groove 265 of component 250. Face 270 of component 250 is magnetized with multiple poles, as is the matching face 295 of component 275, except that these poles are oriented such that they as the pin rides in the groove when the components are brought together. When the pin reaches the L-shaped end of the groove, the poles impart a rotation to the components so that the pin moves into then L-shaped portion of the groove, thus, automatically and safely locking the components together. The user can undo the clasp by counter-rotating the components and then pulling them apart. A wide variety of different mechanical configurations can be created using this principal and all are covered by this invention.

There are numerous ways to provide the plural magnetic locations on the article. Conventional magnetic materials can be buried or hidden in gold, silver or other precious metals that are not magnetizable. In this way, the precious metal would provide the desired appearance of the piece while the hidden magnetized material would provide the desired magnetic pole.

A less complex way to achieve this result is to utilize a magnetizable precious metal, such as POLARIUM® as described herein. This alloy can simply be magnetized in the desired locations using the appropriate fixtures as is known to the skilled magnetist.

Other magnetizable precious metal alloys can also be used if desired. In all cases, the magnetic strength of the alloy must be sufficiently high to provide secure magnetic joining of the components without generating high magnetic fields that would affect magnetic sensitive components when handled by a wearer of the jewelry. For example, a person wearing a ring according to the invention can safely handle credit cards or computer diskettes without damaging the electronic information therein. A distance of as small as 1/16th of an inch or less between the article and magnetic sensitive component is generally sufficient to avoid problems of this type.

For costume jewelry or other less expensive pieces, any conventional permanent magnet can instead be used. These can be visible or hidden, such as by coatings, encapsulation, or encasement, or as an inlay or by placement into a recess in a jewelry article or component.

Another use of the components of the invention is as two discontinuous members that when joined form a continuous item. For example, two "U" or "C" shaped members can be designed to be magnetically joined to form, e.g., a circle or oval. In this way, a chain can be fastened by interconnecting the first individual components prior to magnetically joining the second individual component to complete the loop. In addition, charms or other items can be easily and removably added or taken away from the links as desired.

This is illustrated in FIG. 7, where chain 300 has C-shaped links 301, 302 magnetically joined together while physically interlocked. Chains 303, designs 304 or letters 305, can be added to the chain as desired and are removable if changes need to be made for any reason.

FIG. 9 illustrates the most simple construction for a self-sizing ring according to the invention. The ring 310 is made of two jewelry-forming components 315, 320. Each component is a semi-circle having a female element 325, 330 and a male element 335, 340. The inner diameter of the female element is preferably uniform along its length and is chosen to be slightly larger than the outer diameter of the correspondingly configured male element to allow the male element to move freely into and out of the female element. The interiors of the female elements are shown in phantom lines. Instead of having uniform diameters along their lengths, the male member and female member can have gradually decreasing diameters again configured so that the male element can move freely into and out of the female element.

Any cross sectional configuration of the male and female elements is possible. Although shown as round in the preferred embodiments of these components, other configurations such as polygonal, elliptical or combinations thereof. While the male and female components are preferably of the same configuration, this is not necessary and any matable configurations can be used. Also, the shape of the outer surface of these components is unlimited and can be of any desired shape with or without additional ornamentation, undulations, or other surface characteristics.

It is this movement in combination with the magnetic attraction of the elements that allows the ring to be self-sizing. The movement of the parts is illustrated in FIG. 9 by arrows. The parts are magnetized sufficiently so that male and female elements engage and are magnetically held together. This is easily done by imparting one magnetic force (i.e., either positive or negative) to the body 345 of the component behind the female portion, and by imparting the opposite magnetic force to the male element. Alternatively, one magnetic force can be imparted to the rear portion 350 of the male element, while the opposite magnetic force can be imparted to the female element. In each case, the male and female ends of the components would be attracted to each other, urging the male element into the female element to result in a magnetic connection of the components. The ring is simply and easily formed by simply inserting the male element of each component into the female element of the other component and allowing the magnetic attraction to cause the parts to come together and stay in place.

In another arrangement, illustrated schematically in cross-section FIG. 10, a more permanent connection between the components of the ring or jewelry piece can be achieved by providing the male elements with a larger head 355 in combination with a crimped or flanged end 360 at the end of the female element. While this structure allows the male element to move within the female element, if prevents the male element from being removed from the female element. Instead of the crimped or flanged end, a pin, screw or the like could simply be provided near the opening of the female element so that, after the male element head is inserted, the pin or screw can be used to prevent the head of the male element from being withdrawn from the female element cavity. Also, the male end can be provided with a groove and snap ring to provide the larger portion that prevents removal of the head from the cavity. Other arrangements for achieving this structure, such as an interlocking design, are well known to skilled artisans and can alternatively be used if desired.

In the most compact state of the ring or jewelry piece, each male element is inserted as far as possible into the female element. A cavity of finite depth can be used so that the forward end of the male element stops by abutting the innermost end of the female element. Alternatively, when a tube or tubular cavity is used as the female element, the rearward portion of the male element can be provided with a shoulder or other protrusion which will act as a stop. These define the smallest size of the piece. Of course, each component can be separated so that a much larger size is provided.

The ring of FIG. 9 is easily slid onto the wearer's finger and expanded over the wearer's knuckle with little effort. The force applied by the user's hands to slide on the ring easily overcomes the appropriate magnetic force between the male and female elements, thus allowing the ring to expand. As the ring is slipped onto the finger of a wearer, the diameter of the finger knuckle, being larger than inner diameter of the ring; urges the components away from each other. After proper placement at the base of the finger, the magnetic attraction of the male and female elements provides the smallest size that snugly and comfortably conforms to the base of the wearer's finger without compressing or squeezing it. Also, by overcoming the magnetic attraction force, the parts can be slightly separated to accommodate movement over the knuckles or variations of finger diameters to easily put on or take off the ring. This enables the ring to be self-sizing in that it will conform to many different finger sizes as well as facilitate movement over large or arthritic knuckles without pain or effort. A snug but comfortable fit of the ring is provided on the person's finger without having to measure the finger or select particular predetermined ring sizes by trial and error sampling.

"Self-sizing to the wearer" means that the article of jewelry includes jewelry-forming components that in one configuration has magnetically attracted elements that provide a minimum circumference, perimeter or length to the article, but that the elements may be moved relative to each other so that the article can attain a maximum circumference, perimeter or length which facilitates placement of the article around the finger, wrist, ankle, arm, leg, neck or waist of the wearer. Generally, the magnetically attracted components can be separated or moved further apart by the hand strength of the wearer so that a larger size of the article is achieved; and that after placement on the wearer, the elements are magnetically attracted to the extent that a smaller or comfortably snug fit of the article on the wearer is achieved without uncomfortably compressing or squeezing the body part of the wearer.

While the drawing figures utilize rings as preferred examples of jewelry articles that can be made from the magnetic jewelry components of the invention, the skilled artisan would of course recognize that other items, such as bracelets, ankle or belly chains, necklaces or watchbands can be made in the same manner. In those pieces, however, the parts can be designed with a different curvature and a larger number of components would be magnetically joined together to make the piece. As to curvature and overall configuration of the components, anything from a straight to any appropriately curved configuration would be acceptable, and the user could select different combinations depending upon the desired final visual appearance of the article.

As above, different stones, settings or other decorative or ornamental elements can be carried by one or more or even by all of the components. For these types of articles, a clasp or other closure element is not necessarily required as the parts are retained in connection due to magnetic force. Of course, there is no reason why a conventional clasp or other end joining member cannot be used, if desired, for a particular effect.

This connection feature is obtained by providing the mating portions of the components with sufficient magnetic strength so that the elements try to move as closely together as possible. This is conveniently achieved by providing a magnetic strength of between 200 and 4500 Gauss depending upon distances between the parts, types, shapes and sizes of magnets, etc. As the skilled artisan would know, this magnetic strength should be sufficiently low that the elements can be easily separated either by simply sliding the article over the finger, foot, hand, head, legs or torso of the wearer, or by using hand strength to pull apart or expand the article. Depending upon the specific designs utilized, the article can be separated into the jewelry-forming components or the components can be moved to different relative positions, thus enabling the article to temporarily assume an expanded or larger size configuration to facilitate placement on the wearer.

As noted above, the magnetized portion of the body member has a sufficiently high magnetic strength to retain the male member within the female, member to hold the jewelry article together, but this magnetic strength is not greater than that provided by the strength of an average person's hands. Thus, the person or wearer of the article has enough strength to retract or pull apart the male member at least partially from within the female member. This enables the size of the article of jewelry to be adjustable to accommodate placement on the wearer. In some designs, if desired or necessary, the components can be disassembled to allow cleaning or rearrangement. Different components can reassembled in a different arrangement, if desired, or can be interchanged with other components of similar size to provide a different appearance to the piece, e.g., by providing different colors, stones or other items to match the clothing or the wearer or to simply provide a different visual effect to the piece.

In a preferred embodiment, the inner surface of the female element has a relatively uniform circumference so that the male element can easily move into or out of the female element. This enables the components to be separated or taken apart for ease of removal or for cleaning. This construction also facilitates reconnection of the components in different combination or with different components to alter or modify the overall appearance of the ring. Although two components are illustrated in FIG. 9, it is within the skill of the art to use any reasonable number of components to create further adjustability to the ring. Depending upon the size of the components and the desired final size of the ring, anywhere. between two to as many as thirty or more components can be used. These components can all be of the same size for convenience of manufacture, or one or more or even all of them can be of different sizes, shapes or lengths. As above, different stones, settings or other decorative or ornamental elements can be carried by one or more or even by all of the components. The components can be combinable in a specific sequence, with the sizes selected or configured so that only one connection arrangement is possible, or they can be sized to be interchangeable to enable the user to change the appearance of the ring by assembling the components in a different order or arrangement. One of ordinary skill in the art can devise numerous jewelry arrangements and configurations now that these jewelry-forming components have been developed.

In another preferred embodiment, a four-part ring 400 can be made in a slightly different way, as illustrated in FIG. 11, where two dual female elements 380, 385 can be connected to two dual male elements 390, 395. The mate components can be provided with one type, of magnetic force (i.e., positive or negative) while the female components can be provided with the opposite magnetic force so that these components may be magnetically coupled as shown. Alternatively, coupling may be achieved by providing each end of the female component with a different magnetic polarity and providing the mating male components with an opposite polarity to that of the female components.

Female component 380 is an arcuate tube the entire body of which is magnetized to one polarity while male component 395 is a solid arcuate rod that is magnetized with an opposite polarity to that of the female component 380. Male component 390 illustrates another feature of the invention, namely the use of a hinge 370 that allows the ends 390A, 390B of the male component to move relative to each other as those ends are slidingly coupled with the female elements 380, 385. Of course, male elements 390A, 390B would be magnetized with a polarity that is opposite to that of the female components 380, 385 so that those parts can be magnetically coupled.

Female component 385 illustrates an alternative embodiment, where a magnetized pellet or disk 375 having the opposite polarity to that of the polarized male components 390B, 395. This pellet or disk 375 can be inserted in the interior of the tubular female element 385 and spaced from the ends so that it can provide a magnetic force that attracts the opposite magnetic force of the male elements 390B, 395. This pellet or disk 375 can vary over a wide range of sizes add shapes, its only requirement being that it have a sufficient magnetic strength to attract the forward end of the male element in the manner described herein. Conveniently a circular disk, reminiscent of a miniature coin, as shown, is the easy to manufacture and assemble, and is preferred. This disk 375 can be adhered or otherwise affixed in place near the center of the cavity of the tubular female component 385 so that it cannot be dislodged or removed. The disk can be fixed in place using an adhesive, a solder, or a mechanical construction, such as a press fit, retaining screw or pin etc. In addition, the arcuate tube female component 385 can retain more than one disk therein, with each disk placed adjacent the final position of the male components therein. When a hollow tube is used, the disks can form the ends of the female cavities and act as a stop to the insertion of the male components. In the ring of FIG. 11, the male components are shown as arcuate, but they instead can be bent or straight rods that are magnetically attracted to the disk and that have an outer diameter or configuration that is smaller than the diameter of the tube opening.

The outer surface of the female element is generally illustrated as being uniform, but it also can be stepped or tapered as selected by the designer to achieve the desired visual effect. The taper presents a smooth transition between the male and female elements. The same is true for the design of the male element, keeping in mind that it must be shaped and size fit within the female element. Also, tapering of the male element can be used to provide a stop which prevents too great of a contraction of the size of the ring. Other stop members can be provided, such as pins, collars, stepped surfaces or the like. This stop member can also be controlled by the length of the male member and its abutting to the inside end of the female member. The female and male portions can be configured in any manner as described above so long as they allow the male elements to move easily into and out of the female elements. Also, as described above, the design of the female cavity and male end can be used to control the minimum size of the jewelry article.

FIG. 12 illustrates the final ring 400 made of the jewelry-forming components of FIG. 11. Furthermore, differently adorned, colored or shaped male or female elements can be provided, so that rings of different appearance can be formed depending upon the desires of the user by combining different components. For example, the male elements can be made of a platinum alloy having a silver or white color while the female portions can be made of a magnetized gold colored alloy. Alternatively, different stones can be provided on different but interchangeable-elements so that different appearances can be made based on the selection of the components to be magnetically combined in the ring.

Typical sizes for the jewelry-forming components of the invention can vary over a wide range. Generally, arcuate shaped components are used, but the designer has an unlimited selection of desirable sizes, shapes, colors, etc., depending upon the visual effects to be achieved, of course limited only by sizes that can be worn by the wearer without discomfort or injury. As a further example of this, a hexagonal shaped flattened ring can be provided, as shown in FIG. 13.

The components of the invention can be used for many purposes. For example, a conventional necklace can be provided with a plurality of components that have oppositely polarized male (or female) elements extending away from the wearer. Then a plurality of ornamentations, such as gem or stone settings or metal shapes, e.g., cubes, polygons, figures, letters or numbers, etc., can be provided with a female (or male) element of opposite magnetic polarity to that of the male elements, This allows the user to connect the ornamentations onto the necklace in a desired manner by magnetically coupling the male and female elements. This arrangement allows the user to custom design the necklace for the occasion by adding the desired stones and other ornamentations, Moreover, since the couplings are not permanent, the necklace can be rearranged or redesigned as desired for future uses.

By including an appropriate post or clasp arrangement on one of the jewelry-forming component of the invention, the skilled artisan is able to create a wide range of earring designs from such components. In addition, one of ordinary skill in the art would recognize that the components of the invention can be used in combination with additional functional parts such as hinges, rivets, ball and socket joints, and other engineered items that allow for motion between the components. When a ball and socket type joint is used, the ball and socket can be magnetized with different polarities so that the can be maintained together in magnetic association. The final jewelry articles that can be made vary greatly, thus demonstrating the versatility of the jewelry-forming components of the invention.

FIGS. 14A and 14B illustrate two self-sizing rings 425, 450 that are based on magnetic attraction. In FIG. 14A, a first series of links 405 that include a slot 415 are connected to a second series of links 410 that include a pin 420. The ring of FIG. 14A is illustrated in its fully expanded position, such as when the ring would be slipping over the knuckle of a wearer's finger. The wearer's finger overcomes the force of attraction of the magnets to move them apart and the slot 415 and pin 420 arrangement provides the minimum and maximum circumference of the ring. A related design is illustrated in the ring 450 of FIG. 14B, except that the links 455 are configured in a different interlocking shape and the pins and slots are not visible to the wearer.

Additional features of the invention are illustrated in FIGS. 15-18, which show self-sizing rings based on magnetic repulsion and constructions for making the same. In these Figures, dimensioning members that are arcuate in shape are described, however, the dimension members can be straight sections or in the form of discrete buttons or any other shape that is. complementary to a portion of the body member of the ring.

FIGS. 15A and 15B illustrate a self-sizing ring based on the principle of magnetic repulsion. The ring includes a round body member 510 and three dimensioning members 530 that are anchored to the inner surface of the body member 510. If desired, an adornment in the form of an inlaid band 520 of a different metal can be provided as an adornment for further enhanced design and appearance of the ring. The body member 510 and dimensioning members 530 are imparted with the same magnetic polarity and therefore are magnetically repulsing, such that, in the ring's natural configuration, the dimensioning members are positioned as remotely from the body member as the anchor allows and form a smaller ring inside the inner surface of the body member. This is shown in FIG. 15B.

FIG. 15A illustrates the positions of the dimensioning members when they are urged outwardly and into close proximity with the inner surface of the body member, such as would occur when the ring is slipped onto a wearer's finger. This configuration would be obtained as the ring passes over a knuckle or other enlarged circumference portion of the wearer's finger.

Preferably, the dimensioning members 530 are configured anchored into the ring so that they can separate from the body member when the ring is not being worn or when the ring is being removed from the wearer's finger. Of course, when worn, the wearer's finger acts as an inner stop to prevent such separation, but when otherwise removed, magnetic force would separate the dimensioning members from the body member and possibly cause them to be lost. There may be situations where an anchoring member is not present, so that the wearer can have the ability to substitute different dimensioning members to either vary the minimum internal circumference of the ring or to change colors, designs, etc., so that the ring obtains a different appearance.

When an anchoring element is used, the dimensioning members 530 are normally positioned in the most remote location spaced from the body member 510. This is easily accomplished by providing a further element on the body member. One configuration is shown in FIGS. 16A and 16B. This further element is preferably of simple construction, and can simply be a narrowed opening 550 of the channel 560 that is to receive the dimensioning member 530. In this way, the dimensioning member 530 can be provided with a post 570 and enlarged head 580, with the enlarged head 580 being held within and incapable of passing through the narrowed opening 550 of the channel. This presents some challenges to the designer to properly configure an arcuate dimensioning member with an enlarged head that can slide into a channel of the body member which channel can later be permanently narrowed to prevent passage therethrough of the head of the dimensioning member. The final structure, in cross-section, would be similar to that shown in FIG. 10.

Another arrangement can include a channel 600 of uniform cross section in the body member 510 to receive an enlarged head 610 of the dimensioning member 530. After this head 610 is received in the channel, a bar 630 or other component can be mechanically inserted, welded or brazed into place along the edge of the channel to narrow the opening to prevent passage of the enlarged head of the dimensioning member therethrough to this prevent separation or removal of the dimensioning member from the body member. A suitable mechanical connection of the bar 630 is to connect it using one or more pins or screws 620 that pass through a hole in the body member and into the bar, as shown in FIG. 17. Although two bars 630 are shown, it is also possible to configure the channel with only one bar and to cast or machine the other bar as an integral, art of the body member. This still creates an initial channel opening that is sufficiently large to enable the enlarged head to pass therethrough prior to retaining it therein by the application of the bar 630.

These examples are not intended to be limiting for the invention, as skilled artisans can easily create additional structures or methods to accomplish this type connection.

There is no concern of catching a wearer's finger when sliding the ring thereon since the dimensioning members are urges away from the skin as the finger moves in but they do not tightly expand after the ring is properly seated on the finger. However, these structures allow the dimensioning members to move away from or towards the body member while being still connected to the body member.

The magnetic repulsion between the body member and the dimensioning members has a maximum strength that can be overcome by a person's hand strength. Generally, as a skilled artisan would know, a magnetic strength of between 200 and 4500 Gauss, depending upon distances between parts, types, shapes, and sizes of magnets, would be sufficiently low to be overcome by hand strength or by force applied in wearing the product. Hence, the force applied by the wearer to slide on the ring easily overcomes the magnetic force between the body member and the dimensioning members, urging the dimensioning members to spread out. With the wearer's hand strength urging the dimensioning members to spread out, the ring attains a different configuration in which the dimensioning members are moved towards and positioned close r to the body member.

The present invention, therefore, enables the ring to effortlessly expand over the wearer's knuckle and slide onto different finger sizes. Specifically, as the ring is slipped onto the wearer's finger, the diameter of the finger knuckle, being larger than the inner diameter of the ring, urges the dimensioning members to spread out and provide room for the ring to pass over knuckle. When smaller, discrete or discontinuous dimensioning members are used, even more space is provided between the inner periphery of the ring and the wearer's knuckle. The mobility of the dimensioning members into the cavity of the body member facilitates movement of the ring over knuckles or different finger diameters so that the wearer can easily put on or take off the ring. After proper placement at the base of the finger, the magnetic repulsion provides the smallest size that. snugly and comfortably conforms to the base of the wearer's finger without compressing or squeezing it. This enables the ring to be self-sizing in that it conforms to many different finger sizes and, further, accommodates movement over large or arthritic knuckles without pain.

Hence, a jewelry article made with the present invention is "self-sizing to the wearer," meaning that the article includes a jewelry-forming component whose magnetically repulsed elements provide a minimum circumference, perimeter, or length to the article in one configuration but may move relative to each other so that the article can attain a maximum circumference, perimeter or length, thereby facilitating placement of the article around the finger, wrist, ankle, arm, leg, neck or waist of the wearer. Generally, the magnetically repulsed elements can be moved towards each other by the wearer's hand strength so that a larger size of the article is attained with ease. After placement on the wearer, the elements are magnetically repulsed to the extent that a smaller, comfortably snug fit on the wearer is achieved without uncomfortably compressing or squeezing the wearer.

In a preferred embodiment, the ring can accommodate three conventional finger sizes (for example, sizes 5 through 7), so only about three ring sizes (small, medium, and large) are needed to accommodate just about any wearer. The invention, therefore, provides a snug and comfortable fit on the wearer's finger without requiring extensive measurement or trail and error sampling, and significantly reduces the inventory of necessary ring sizes that a manufacturer or seller must carry.

Typical sizes for the jewelry-forming component of the invention can vary over a wide range, limited only by sizes that can be worn by the wearer without discomfort or injury. Depending on the size of the component and the desired size of the final product, as many as sixteen to thirty-two dimensioning members may be used. The dimensioning members may all have the same size for the convenience of manufacture, or they may have different sizes, shapes, or lengths, as desired for the final product.

In one advantageous embodiment, the inner surface of the body member may define a cavity with a depth sufficient to receive the dimensioning members, so that the dimensioning members fit inside the hollow cavity when the jewelry product is worn and the entire inner surface of the product feels relatively flat and smooth to the wearer.

Further, where a gap is created between dimensioning members as they are pushed towards the body member and spread out, the gap may be filled with a filler, such as a ramp. A filler can prevent the wearer's tissues from being caught between dimensioning members, and a two-sided ramp that rises up to the dimensioning members' natural position is especially advantageous, because it would allow smooth transition between different configurations.

Any magnetizable material can be used in the present invention, but for fine jewelry the invention preferably utilizes magnetic precious metal alloys that have magnetic properties and high hardness. These magnetic precious metal alloys are ideally suited for malting various forms of fine jewelry that provide new and unusual visual and functional properties. The alloy's magnetic properties enable the components to either be attracted to or repelled by other components of different or like polarities. This, in turn, enables the jewelry designer to create a variety of precious metal pieces with magnetically connected components. A wide range of new precious metal jewelry components can now be made with heretofore unknown connections due to the magnetic properties of the alloys that are used therein.

The preferred alloys for use in this invention are platinum based and contain at least about 70% platinum by weight. While amounts as high as 95% by weight are suitable, the most preferred amount is between 75 and 80% by weight as these amounts enable the strongest magnetic properties to be achieved. In order to impart magnetic properties to these alloys, cobalt is added and the alloy is heat-treated. The amount of cobalt can range from about 5 to 30% by weight, and is complementary to the weight of the platinum. As between these two components, a weight ratio of 70:30 to 95:5 Pt:Co is preferable. An example of this material is known as POLARIUM® and is available from the inventor. This alloy, which is disclosed in US patent application 2003/0215351 A1, is preferred for fine jewelry because it has greater magnetic power than known magnetic gold alloys.

Although the invention is shown with a round body member and arcuate dimensioning members in the preferred embodiment, other shapes such as polygonal, elliptical or combinations thereof may be used. The outer surface of the body member can also be varied in shape and may be ornamented with gem or stone settings, curvature, undulations, or such other characteristics. Given the flexibility of the present invention, the designer has an unlimited choice of sizes, shapes, colors, and decorative or ornamental elements, to achieve the desired visual or functional effects of the final product.

Moreover, while the drawings show a ring as a preferred example of a jewelry article that can be made from the present invention, a skilled artisan would readily recognize that other items, such as bracelets, anklets, chokers, necklaces, earrings, or watchbands can be made in the same manner. The great variety of possible final jewelry products thus demonstrates the utility and versatility of the jewelry-forming component of the present invention.

Of course, various changes and modifications of the preferred embodiments are apparent to the skilled artisan after viewing this disclosure. For example, while certain embodiments illustrate two ring portions, it should be understood that three, four, or more can be used and fall within the scope of the present invention. This allows the designer to create multiple portion rings, clasps, bracelets or necklaces, etc., which portions are attracted to each other when worn. Also, the ring portions can be concentric, where one fits into the other, and the outer one has windows or cut-out portions to allow viewing of the adornments on the outer surface of the inner ring. The ability of the outer ring to move and be fixed in different relative positions allows the wearer to reveal different ornamentations or adornments of the inner ring. Any changes and modifications that fall within the true spirit and scope of the inventions disclosed herein are intended to be encompassed and covered by the appended claims.

What is claimed is:

1. A jewelry-forming component for preparing a jewelry article comprising a body member configured and dimensioned in an ornamental shape and having a first magnetizable portion for repulsive magnetic association with at least one other magnetic jewelry-forming component, wherein the body member has a magnetic strength that can be overcome by a person's hand strength such that the body member and at least one other magnetic jewelry-forming component can be placed in different positions relative to each other, and wherein the further element comprises a retaining structure that includes a mechanical connection that prevents complete separation of the body member from the at least one other magnetic jewelry-forming component when the first magnetized portion of the body member is magnetically repulsed from the at least one other magnetic jewelry-forming component, wherein the body member has outer and inner surfaces, the at least one other jewelry-forming component comprises at least one dimensioning member that is operatively associated with the body member with the first magnetizable portion of the body member and the body member defines a cavity having a depth sufficient to receive the at least one dimensioning member such that the dimensioning member fits inside the cavity when urged therein by a person's hand strength but is magnetically repulsed from the body member with a maximum magnetic strength that can be overcome by a person's hand strength, such that the magnetic repulsion between the body and dimensioning members enables the component to attain a first configuration wherein the dimensioning member is positioned remotely from the body member and a second configuration wherein the person's hand strength urges the dimensioning members towards the body member, so that the jewelry component can be adjusted to conform to the person;

wherein the cavity includes a narrowed or partially blocked opening and the mechanical connection comprises an extension provided on the dimensioning member that fits through the narrowed opening and includes an end portion having a size or shape that is larger than the opening so that the at least one dimensioning member cannot be completely separated from the body member.

2. The jewelry-forming component of claim 1, wherein the body is configured in the shape of a ring and the at least one dimensioning member has an arcuate shape that is complementary to a portion of the ring.

3. The jewelry-forming component of claim 2 wherein the ring is oval or round and includes between two and sixteen dimensioning members.

4. A jewelry article in the form of a finger or toe ring, bracelet, anklet, choker, necklace, earring, or watchband comprising the jewelry-forming component of claim 1 so that the article is self-sizing to the wearer.

5. A jewelry-forming component for preparing a jewelry article comprising a body member configured and dimensioned in an ornamental shape and having a first magnetizable portion for repulsive magnetic association with at least one other magnetic jewelry-forming component, wherein the body member has a magnetic strength that can be overcome by a person's hand strength such that the body member and at least one other magnetic jewelry-forming component can be placed in different positions relative to each other, and wherein the further element comprises a retaining structure that prevents complete separation of the body member from the at least one other magnetic jewelry-forming component when the first magnetized portion of the body member is magnetically repulsed from the at least one other magnetic jewelry-forming component, wherein the body member has outer and inner surfaces, the at least one other jewelry-forming component comprises a plurality of dimensioning members that are operatively associated with the body member with the first magnetizable portion of the body member and each dimensioning member magnetically repulsing each other with a maximum magnetic strength that can be overcome by a person's hand strength, such that the magnetic repulsion between the body and each dimensioning member enables the component to attain a first configuration wherein each dimensioning member is positioned remotely from the body member and a second configuration wherein the person's hand strength urges at least some of the dimensioning members towards the body member, so that the jewelry component can be adjusted to conform to the person;

wherein the body is configured in the shape of a ring and includes a ramp positioned adjacent a dimensioning member to minimize gaps between adjacent dimensioning members.

6. A jewelry article in the form of a finger or toe ring, bracelet, anklet, choker, necklace, or watchband comprising the jewelry-forming component of claim 5 so that the article is self-sizing to the wearer.

7. The jewelry-forming component of claim 5 wherein the at least one dimensioning member has an arcuate shape that is complementary to a portion of the ring.

8. The jewelry-forming component of claim 7 wherein the ring is oval or round and includes between two and sixteen dimensioning members.

* * * * *